US009272513B2

(12) United States Patent
Nakano et al.

(10) Patent No.: US 9,272,513 B2
(45) Date of Patent: Mar. 1, 2016

(54) LIQUID EJECTING APPARATUS AND LIQUID EJECTING METHOD

(71) Applicant: SEIKO EPSON CORPORATION, Tokyo (JP)

(72) Inventors: Yoji Nakano, Matsumoto (JP); Satoshi Shimizu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/962,469

(22) Filed: Aug. 8, 2013

(65) Prior Publication Data

US 2014/0043385 A1 Feb. 13, 2014

(30) Foreign Application Priority Data

Aug. 10, 2012 (JP) ..... 2012-179089

(51) Int. Cl.
*B41J 2/125* (2006.01)
*B41J 2/175* (2006.01)

(52) U.S. Cl.
CPC ..... *B41J 2/125* (2013.01); *B41J 2/17509* (2013.01)

(58) Field of Classification Search
CPC ..... B41J 2/125; B41J 2/0458; B41J 2/04563; B41J 29/393; B41J 11/007; B41J 11/06
See application file for complete search history.

(56) References Cited

U.S. PATENT DOCUMENTS

| | | | | |
|---|---|---|---|---|
| 2005/0195231 | A1* | 9/2005 | Kasamatsu | 347/14 |
| 2009/0040254 | A1* | 2/2009 | Umeda | 347/12 |
| 2011/0018947 | A1* | 1/2011 | Kobayashi | 347/85 |
| 2012/0075377 | A1* | 3/2012 | Kyotani | 347/16 |

FOREIGN PATENT DOCUMENTS

| | | |
|---|---|---|
| CN | 2825289 | 10/2006 |
| TW | 538909 | 6/2003 |

* cited by examiner

*Primary Examiner* — Julian Huffman
*Assistant Examiner* — Jeremy Delozier
(74) *Attorney, Agent, or Firm* — Workman Nydegger

(57) ABSTRACT

A printer includes an apparatus main body and an image reading unit. The apparatus main body includes an opening in which at least a part of a stroke region of a carriage is exposed. An ink supply tube extending from an ink tank is routed through between the apparatus main body and the image reading unit, and inserted through the opening to supply ink to a liquid ejecting head. Although the image reading unit is unable to be closed because the tube runs on the upper face of the apparatus main body, a sensor is activated by inserting an insertion piece into a detection recess, so that a printing operation is permitted to be performed.

16 Claims, 15 Drawing Sheets

LIQUID EJECTING APPARATUS AND LIQUID EJECTING METHOD

BACKGROUND

1. Technical Field

The present invention relates to a liquid ejecting apparatus that ejects a liquid onto a target, and to a liquid ejecting method.

2. Related Art

Liquid ejecting apparatuses thus far developed include an ink jet printer that ejects ink from a liquid ejecting head onto a target such as a paper sheet, to thereby perform a printing operation. To successively and stably supply the ink to the liquid ejecting head of the printer thus configured when printing a large amount of data, a system including an ink tank having a relatively large capacity has been proposed, to supply the ink to an ink cartridge through an ink supply tube (for example, see Taiwanese Patent No. 538909).

In the printers of this type, the liquid ejecting head is mounted on a carriage set to reciprocate in a main scanning direction with respect to the paper sheet, inside the casing of the main body. The ink supply tube is routed from the ink tank located outside the casing into the stroke region of the carriage through an opening of the upper face of the casing, and connected to the ink cartridge mounted on the carriage.

Here, an upper structure (serving also as a cover) that can be displaced so as to open and close the opening is provided on the main casing, and hence the ink supply tube is caught between the casing and the upper structure set to close the opening. Accordingly, a spacer is provided between the upper structure and a peripheral region of the opening, for the ink supply tube to be passed therethrough. The spacer has a generally annular shape to allow the ink supply tube to be inserted therethrough and move in the longitudinal direction. The ink supply tube inserted through inside of the spacer has its outer surface in contact with the inner wall of the spacer, thus to be restricted from moving in a direction intersecting the longitudinal direction.

In addition, some of such printers are configured to detect whether the upper structure is in the closed position, and to inhibit the printing operation through a control unit in the case where the upper structure is open and hence the closed position is not detected.

In the case where the ink supply tube is caught between the apparatus main body and the upper structure in the foregoing printer, the upper structure cannot be completely closed irrespective of whether the spacer is provided, and therefore the printer having the detection function is unable to activate the printing operation. In this case, an orifice may be formed in the casing to pass the ink supply tube through the orifice. However, an exclusive tool for forming the orifice has to be prepared, and besides the process becomes complicated. Further, forcibly closing the upper structure may cause a damage on the ink supply tube and disturb the smooth flow of the ink.

SUMMARY

An advantage of some aspects of the invention is provision of a liquid ejecting apparatus capable of ejecting a liquid despite a liquid supply tube being arranged along a route passing between an apparatus main body and an upper structure, and a method of ejecting the liquid with such a liquid ejecting apparatus.

In an aspect, the invention provides a liquid ejecting apparatus including a liquid ejecting head that ejects a liquid onto a target, a casing in which a carriage having the liquid ejecting head mounted thereon is set to reciprocate, the casing including an opening in which at least a part of the stroke region of the carriage is exposed, an upper structure to be displaced with respect to the casing in a direction to open or close the opening, a liquid chamber containing the liquid and located outside the casing, a liquid supply tube extending from the liquid chamber through the opening, and through which the liquid to be supplied to the liquid ejecting head flows, a feed cassette unit composed of a portion of the casing protruding in a direction in which the target is discharged and a feed cassette in which the target can be placed, the feed cassette being removably mounted in the protruding portion of the casing, an operation panel provided on a sloped surface of the casing, the sloped surface being located above the feed cassette unit and inclined such that a lower portion sticks out in the discharge direction with respect to an upper portion, a recess formed in the casing, a control unit that controls, according to a detector to be activated upon being pressed by an object inserted in the recess, the liquid ejecting head so as to perform a recording operation on the target in the case where the detector is pressed and activated, and to inhibit the recording operation while the detector remains unpressed, and a separate member to be inserted in the recess so as to press the detector, the separate member having a size that secures a gap between the casing and the upper structure that at least allows the liquid supply tube to be passed through the gap without a liquid flow path inside the liquid supply tube being blocked.

With the liquid ejecting apparatus thus configured, even when there is a gap between the casing and the upper structure that at least allows the liquid supply tube to be passed therethrough without the liquid flow path inside the liquid supply tube being blocked, the liquid ejecting head is controlled to perform the recording on the target provided that the detector is pressed by the separate member inserted in the recess. Such a configuration allows the liquid ejecting head to perform the recording, even though a gap of a size that allows the liquid supply tube to be passed therethrough without the liquid flow path inside the liquid supply tube being blocked is present between the casing and the upper structure.

Preferably, the foregoing liquid ejecting apparatus may include a gap forming member that forms a gap between the casing and the upper structure when the upper structure is displaced toward the opening.

With the gap forming member provided between the casing and the upper structure, the liquid can be supplied through the liquid supply tube without the liquid flow path being blocked. Yet, although when the upper structure is displaced toward the opening the gap forming member forms a gap between the casing and the upper structure and thus restricts the upper structure from being completely closed, inserting the separate member in the recess allows the liquid ejecting head to perform the recording.

In the foregoing liquid ejecting apparatus, preferably, the upper structure may include a detection activator, and the separate member may be attached to the detection activator.

With the mentioned configuration, upon attaching the separate member to the detection activator and closing the upper structure, the separate member is inserted in the recess and thus presses the detector. Therefore, the liquid ejecting head can perform the recording.

In the foregoing liquid ejecting apparatus, preferably, the separate member may include a projection formed so as to press the detector when the projection is inserted in the recess, and a base portion having a shape unable to be inserted in the recess and capable of forming the gap between the upper structure and the casing.

The mentioned configuration allows the liquid ejecting head to perform the recording since the projection is inserted in the recess and thus presses the detector, and further the base portion remaining outside the recess is interposed between the casing and the upper structure so as to secure a gap of a size that at least allows the liquid supply tube to be passed therethrough without the liquid flow path inside the liquid supply tube being blocked.

In the foregoing liquid ejecting apparatus, preferably, the separate member may include a fitting recess in which the detection activator is to be fitted, the fitting recess being formed in a face of the base portion opposite to the projection.

In this case, the separate member is brought into contact with the upper structure with the detection activator accommodated in the fitting recess, and therefore the detection activator can be protected.

In the foregoing liquid ejecting apparatus, preferably, the upper structure may include an image reading unit configured to read a source document, and the liquid supply tube may be routed so as not to interfere with a protruding portion formed on the lower face of the image reading unit.

With the mentioned configuration, since the liquid supply tube is routed so as not to interfere with the protruding portion on the lower face of the image reading unit, the liquid supply tube is prevented from being caught by the protruding portion when the image reading unit is closed. In this case, since the liquid supply tube is exempted from being pressed by the protruding portion, the liquid flow in the liquid supply tube can be prevented from being disturbed at the position that would otherwise be pressed.

In the foregoing liquid ejecting apparatus, preferably, the liquid supply tube may be composed of a plurality of tubes connected to each other via a joint fitting.

Connecting thus the plurality of tubes allows the liquid supply tube to be adjusted to an appropriate length.

Preferably, the foregoing liquid ejecting apparatus may include one or a plurality of the liquid supply tubes.

Such a configuration allows the liquid to be supplied to the liquid ejecting head through an appropriate number of liquid supply tubes according to the number of the liquid chambers, from the respective liquid chambers.

In another aspect, the invention provides a liquid ejecting method to be performed by a liquid ejecting apparatus including a liquid ejecting head that ejects a liquid onto a target, a casing in which a carriage having the liquid ejecting head mounted thereon is set to reciprocate, the casing including an opening in which at least a part of the stroke region of the carriage is exposed, an upper structure to be displaced with respect to the casing in a direction to open or close the opening, a liquid chamber containing the liquid and located outside the casing, a liquid supply tube extending from the liquid chamber through the opening, and through which the liquid to be supplied to the liquid ejecting head flows, a feed cassette unit composed of a portion of the casing protruding in a direction in which the target is discharged and a feed cassette in which the target can be placed and removably mounted in the protruding portion of the casing, and an operation panel provided on a sloped surface of the casing, the sloped surface being located above the feed cassette unit and inclined such that a lower portion sticks out in the discharge direction with respect to an upper portion. The method includes inserting a separate member in a recess formed in the casing so as to press the detector, with a gap formed between the casing and the upper structure, the gap having a size that at least allows the liquid supply tube to be passed through the gap without a liquid flow path inside the liquid supply tube being blocked, permitting the liquid ejecting head to perform a recording operation on the target in the case where the separate member inserted in the recess presses and activates the detector, and inhibiting the recording operation in the case where the detector is decided to have been unpressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
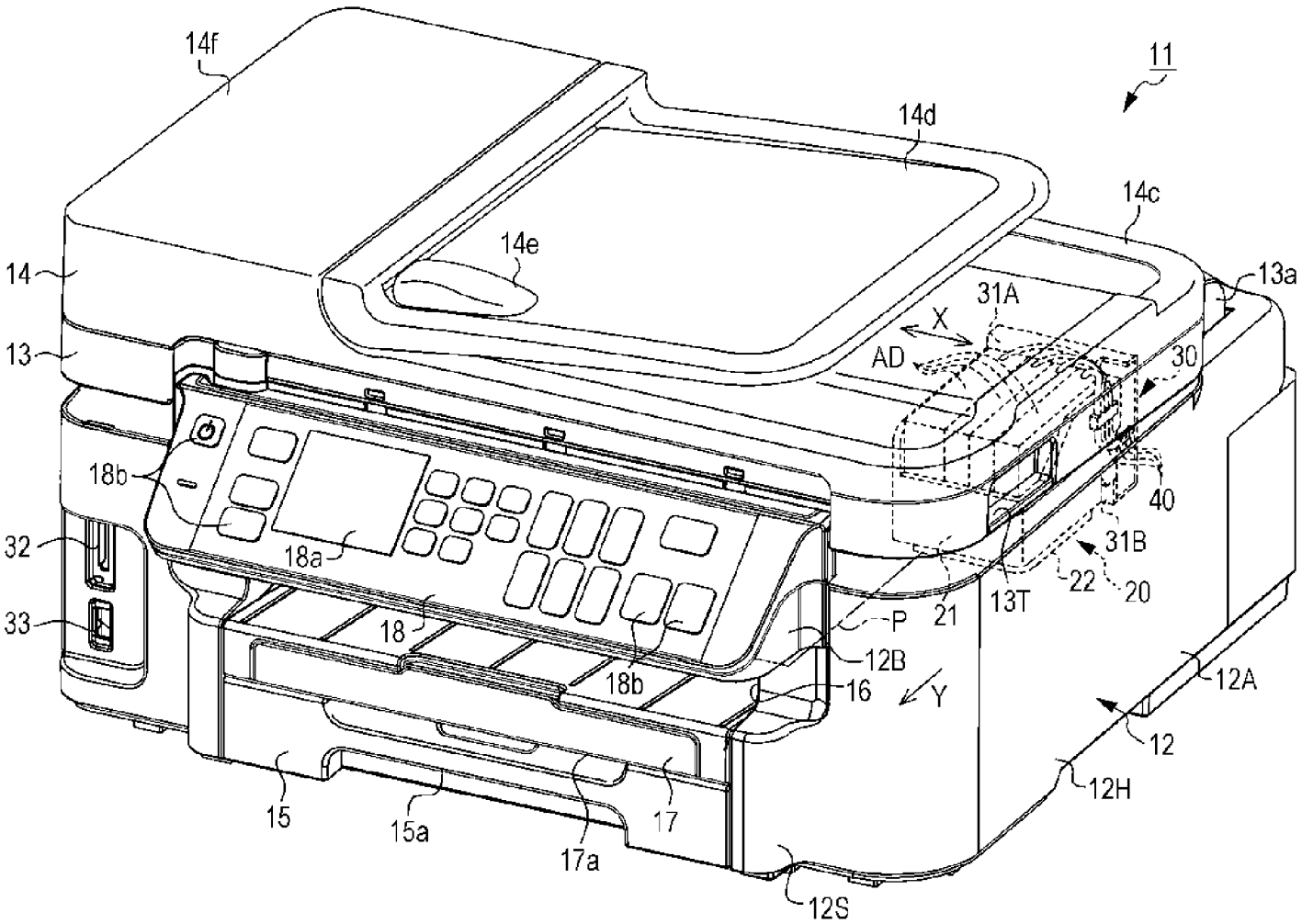
FIG. 1 is a perspective view showing a first printer according to a first embodiment of the invention.

Hereafter, a first embodiment of the liquid ejecting apparatus according to the invention will be described referring to the drawings, taking up an ink jet printer designed to eject ink, an example of the liquid, from a liquid ejecting head onto a paper sheet exemplifying the target, to thereby print images including characters and figures.

As shown in FIG. 1, the printer 11 according to this embodiment is what is known as a multifunction printer composed of an apparatus main body 12 exemplifying the casing and including a printing functional unit 12A capable of performing a printing operation, and an image reading unit 13 superposed on the apparatus main body 12. In the following description, the thus-configured multifunction printer will be referred to as first printer 11. The first printer 11 receives the ink from an ink tank 19T (see FIG. 3) exemplifying the liquid chamber, separately provided and having a generally rectangular block shape, through an ink supply tube 40 (see FIG. 3).

In the first printer 11, the printing functional unit 12A including a printing unit 20 is located on the lower side in the gravity direction, and the image reading unit 13, for example a scanner that reads a source document (image), is provided on the upper side in the anti-gravity direction, the image reading unit 13 exemplifying the upper structure in the invention. The image reading unit 13 is disposed so as to pivot (be displaced) about a hinge 13*a* provided on an end portion (rear end) of the apparatus main body 12, such that the front end portion of the image reading unit 13 opposite to the hinge 13*a* is lifted up. To be more detailed, grab portions 13T of a recessed shape are provided on the respective side faces (left and right side faces) of the housing of the image reading unit 13, so that the user of the first printer 11 can insert his/her hands in the grab portions 13T to lift the image reading unit 13, for example for a maintenance job. When the image reading unit 13 is thus lifted, an opening 12K (see FIG. 3) is exposed, in which at least a part of the stroke region of a carriage 21, set to reciprocate inside the printing functional unit 12A (i.e., inside the apparatus main body 12), is exposed.

Further, an automatic document feeder 14 that automatically supplies source documents to the image reading unit 13 is superposed on the image reading unit 13. The automatic document feeder 14 is disposed so as to pivot about a hinge 14*a* (see FIG. 2) provided on the end portion (rear end) of the apparatus main body 12, such that the front end portion of the automatic document feeder 14 opposite to the hinge 14*a* is lifted up. When the automatic document feeder 14 is thus lifted, a document table 13*b* (see FIG. 2) constituting the upper surface of the image reading unit 13 is exposed, so that the user can manually set the source documents to be read by the image reading unit 13.

The automatic document feeder 14 includes a document tray 14*d* on which the source documents are to be placed, located above a main body 14*c* of a rectangular plate shape, and a guide member 14*e* is provided on the document tray 14*d* for positioning the source documents in the width direction. The source documents placed on the document tray 14*d* are fed onto the document table 13*b* of the image reading unit 13 one by one, by a feed mechanism 14*f* located on the left side in FIG. 1, and discharged onto the main body 14*c* after being read.

In addition, a sheet cassette 15 in which a plurality of paper sheets P can be stacked is removably mounted in the lower portion of the apparatus main body 12. The paper sheets P placed in the sheet cassette 15 are fed one by one in the forward direction from a rear position, to the printing unit 20 installed inside the printing functional unit 12A, so that the printing unit 20 performs the printing operation on the paper sheets P thus delivered. To be more detailed, the paper sheet P delivered from the sheet cassette 15 is transported to the printing unit 20 by a transport mechanism including rollers 24, 25 to be subsequently described. In the printing unit 20, the ink is ejected onto the paper sheet P from a liquid ejecting head 22 made to reciprocate by a drive mechanism in a direction (main scanning direction X) intersecting the transport direction of the paper sheet P (sub scanning direction Y), so that an image is printed on the paper sheet P. The paper sheet P that has undergone the printing operation by the printing unit 20 is discharged through a sheet outlet 16 provided on the front face of the apparatus main body 12 (printing functional unit 12A).

A stacker 17, exemplifying the output tray in the invention, that receives the paper sheet P discharged through the sheet outlet 16 is mounted in the apparatus main body 12 (printing functional unit 12A), above the sheet cassette 15 and under the sheet outlet 16. The stacker 17 is drawn out from the apparatus main body 12 by a length according to the size of the paper sheet P to be discharged, when put to use.

An accommodation region 12S including a cavity at the central portion thereof in the width direction, in which the sheet cassette 15 and the stacker 17 are to be mounted, is formed of a portion of the casing 12H protruding in the discharge direction of the paper sheet P (sub scanning direction Y). It is because the sheet cassette 15 requires a longer distance in the casing 12H in the sub scanning direction Y than does the printing unit 20, that the accommodation region 12S includes such a protruding portion. Accordingly, the sheet cassette 15 and the stacker 17 are mounted in the accommodation region 12S such that the respective front faces become flush with each other, and so as to protrude from the apparatus main body 12 in the sub scanning direction Y (forward direction). Here, in the case where the length of the apparatus main body 12 in the sub scanning direction Y is determined according to the length of the sheet cassette 15 in the sub scanning direction Y required for accommodating the paper sheet P of a predetermined size, for instance A4 size, the apparatus main body 12 inevitably becomes larger in size, resulting in an increase in foot print. Therefore, to minimize such an increase in size to a possible extent, only the portion corresponding to the region for accommodating the sheet cassette 15 is made to protrude. In other words, the respective sides of the accommodation region 12S in which the sheet cassette 15 is mounted are scraped off so as to make the portion corresponding to the sheet cassette 15 and the accommodation region 12S protrude. In addition, the front face of the stacker 17 is flush with the protruding front face of the sheet cassette 15, and hence a relatively long protruding length is secured for drawing out the stacker 17. The stacker 17 includes a grab portion 17*a*, which further facilitates the stacker 17 to be drawn out from the apparatus main body 12. Thus, the increase in size (foot print) of the first printer 11 is suppressed to a certain extent, despite the sheet cassette 15 being removably mounted from the front side of the apparatus main body 12 so as to allow the paper sheet P to be delivered from the front side of the apparatus main body 12.

As shown in FIG. 1, an operation panel 18 for executing various operations, including causing the printing unit 20 to perform the printing, is provided on the apparatus main body 12 (printing functional unit 12A), at a position above the sheet outlet 16. A base portion 12B of the operation panel 18 is constituted of a portion of the casing having a sloped surface formed such that the lower portion sticks out in the discharge direction of the paper sheet P (sub scanning direction Y) with respect to the upper portion. A display unit 18*a* (for example, an LCD panel) for displaying a menu screen and so forth and an operating buttons 18*b* are attached to the sloped surface of the base portion 12B. The operating buttons 18*b* include, for example, a power button, a selection button for selecting a desired item in the menu screen, and a printing execution button for instructing a printing job. Thus, since the operation panel 18 protrudes forward from the apparatus main body 12 and the display unit and the operating buttons are provided on the sloped surface downwardly inclined toward the user, the visibility of the display unit 18*a* and the operability of the operating buttons 18*b* can be sufficiently secured.

The printing unit 20 of the first printer 11 according to this embodiment includes the carriage 21 set to reciprocate in the main scanning direction X, and the liquid ejecting head 22 that ejects the ink is mounted on the carriage 21. The carriage 21 is guided by a guide frame 30 which is a plate-shaped member extending in the main scanning direction X, so as to move (reciprocate) in the main scanning direction X. The guide frame 30 includes an upper rail 31A and a lower rail 31B formed by bending the upper and lower end portion of a plate-shaped member in a U-shape in a direction orthogonal to the main scanning direction X. The carriage 21 has its rear end portion supported by the upper rail 31A and the lower rail 31B, when reciprocating in the main scanning direction X. When the ink supplied from the ink tank 19T (see FIG. 3) through the ink supply tube 40 is ejected from the liquid ejecting head 22 while the carriage 21 is moving, the printing is performed on the paper sheet P.

The carriage 21 has a generally rectangular block shape with an opening directed upward, and an adapter AD that relays the ink supplied through the ink supply tube 40 to the liquid ejecting head 22 is mounted in the recessed chamber of the carriage 21. Thus, the ink is supplied to the liquid ejecting head 22 through the adapter AD mounted in the carriage 21. Accordingly, the ink supply tube 40 connected to the adapter AD constitutes a part of the ink flow path that allows the ink to flow from the ink tank 19T to the liquid ejecting head 22.

The first printer 11 according to this embodiment is designed to perform color printing, and hence a plurality of adapters AD (in this embodiment, four) are mounted according to the number of colors necessary for performing the color printing (in this embodiment, four colors), in FIG. 1. Naturally, only the adapter AD for black ink may be mounted, so as to use the first printer 11 as a monochrome printer. In addition, the carriage 21 is also compatible with ink cartridges, and the adapter AD has dimensions that fit the shape and the size of the ink cartridge compatible with the first printer 11. However, since the adapter AD may have a smaller ink capacity than the ink cartridge, the shape and the size of the adapter AD may be modified as desired, as long as the adapter AD can be mounted in the chamber of the carriage 21.

As shown in FIG. 1, further, the apparatus main body 12 includes a slot 32 for inserting a memory card, a communication card, or the like, and a communication port 33 (connector) compatible with predetermined communication formats, such as USB communication, located on the left end portion of the front face. Accordingly, the first printer 11 is capable of performing a printing operation based on data received from a host apparatus through the USB communication, and based on image data such as a photo retrieved from a memory card.

Figure 2:
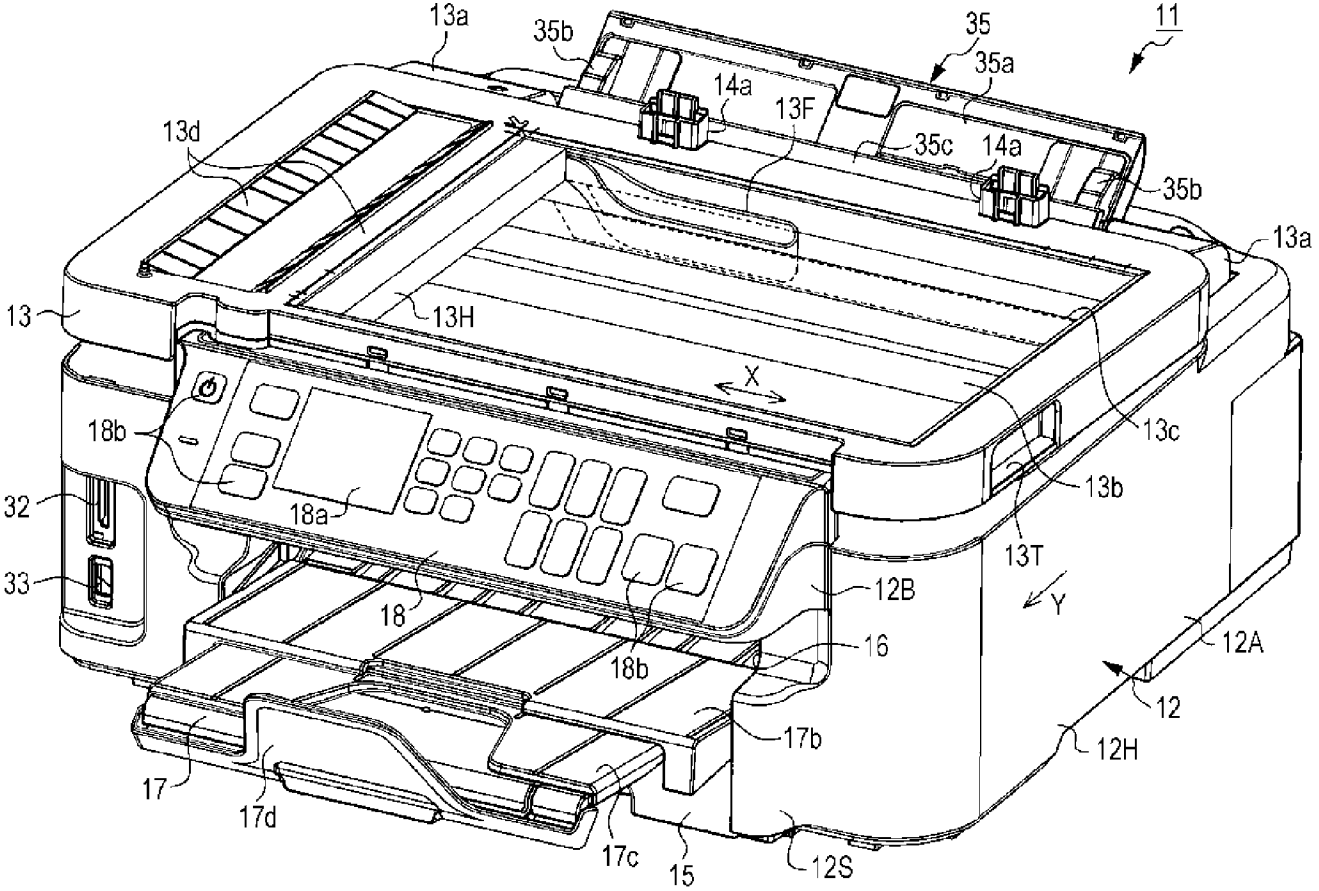
FIG. 2 is a perspective view showing the first printer with the stacker and the manual feed mechanism set to the open position.

FIG. 2 illustrates the first printer 11 from which the automatic document feeder 14 has been removed. When the automatic document feeder 14 is open, the document table 13*b* of the image reading unit 13 is exposed as shown in FIG. 2, and a slender-shaped reading head 13H extending in the sub scanning direction Y is disposed below the reading surface (glass surface) of the document table 13*b*, so as to move in the main scanning direction X. In addition, a groove 13*c* for guiding a flexible flat cable (FFC) 13F connected to an end portion of the reading head 13H is provided on the bottom face of the image reading unit 13, so as to extend in the main scanning direction X. When the reading head 13H moves in the main scanning direction X, the FFC 13F follows up the movement of the reading head 13H along the groove 13*c*, so that the reading head 13H can transmit reading signals of the source document through the FFC 13F to a controller (not shown) in the first printer 11, from the entirety of the moving range. Further, a transport surface 13*d* for the source document delivered from the automatic document feeder 14 is provided adjacent to the document table 13*b*, on the upper face of the image reading unit 13.

As shown in FIG. 2, a manual feed mechanism 35 is provided on the rear side of the apparatus main body 12 (printing functional unit 12A). The manual feed mechanism 35 serves to feed a paper sheet P manually set by the user. The manual feed mechanism 35 includes a sheet tray 35*a* of a generally rectangular plate shape, a pair of sheet guides 35*b* to be manipulated for positioning the paper sheet P on the sheet tray 35*a* in the width direction, and a cover plate 35*c* for preventing a foreign substance from dropping into a sheet inlet (not shown) when the manual feed mechanism 35 is open. The sheet tray 35*a* is set to pivot in a predetermined angular range about the base edge thereof (lower edge in FIG. 2), to be set to an open position in which the sheet tray 35*a* is inclined for receiving the paper sheet P as shown in FIG. 2, and a closed position in which the sheet tray 35*a* is accommodated in the apparatus main body 12 by being made to pivot forward in FIG. 2. The cover plate 35*c* is biased toward the sheet tray 35*a* by an elastic force of a coil spring (not shown), and when the sheet tray 35*a* is opened the cover plate 35*c* is laid down by the biasing force of the spring so as to overlap the sheet tray 35*a* with a narrow gap at the lower end portion of the sheet tray 35*a*, thus to be set to the protection position for preventing a foreign substance from intruding in the sheet inlet located below the sheet tray 35*a*, as shown in FIG. 2.

The stacker 17 is, for example, composed of three levels including a first tray 17*b*, a second tray 17*c*, and a third tray 17*d*. The first tray 17*b* is slidably connected to the apparatus main body 12, and the second tray 17*c* is slidably connected to the first tray 17*b*. The third tray 17*d* is pivotably connected to the front edge of the second tray 17*c*, to be set to a closed position in which the third tray 17*d* is accommodated in the second tray 17*c* so as to overlap, and an open position in which the third tray 17*d* is lifted at a predetermined angle as shown in FIG. 2 so as to serve as a stopper of the paper sheet P.

Figure 3:
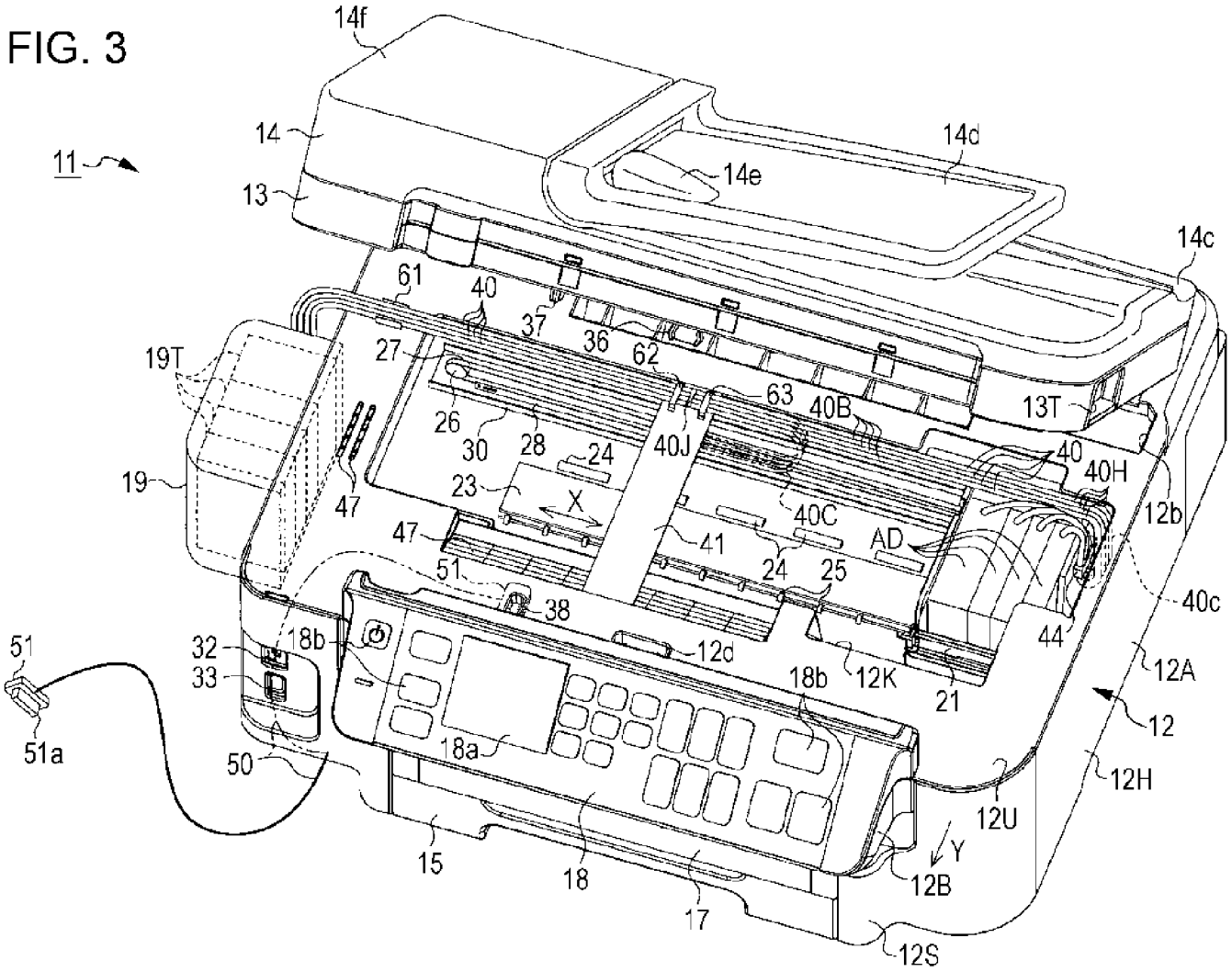
FIG. 3 is a perspective view showing the first printer with the image reading unit set to the open position.

Referring now to FIG. 3, the general configuration of the printing unit 20 will be described. In the casing 12H, as shown in FIG. 3, a slender-shaped support base 23 extending in the main scanning direction X is disposed so as to oppose the lower face (nozzle face) of the liquid ejecting head 22 (see FIG. 1) attached to the lower face of the carriage 21. A transport roller 24 and a discharge roller 25 are provided on the upstream side and downstream side respectively, across the support base 23 in the sub scanning direction Y. When a pickup roller (not shown) disposed in contact with the uppermost one of the paper sheets P placed in the sheet cassette 15 is made to rotate, that paper sheet P is delivered in the backward direction. The paper sheet P thus delivered is inverted in the sub scanning direction Y along the outer circumferential surface of a feed roller (not shown) and, upon reaching the transport roller 24, fed to the position on the support base 23 by the rotation of the transport roller 24.

In the casing 12H, further, an endless timing belt 27 wound on a pair of pulleys 26 is disposed along the guide frame 30 on the rear side of the carriage 21, and the rear face of the carriage 21 is fixed to a part of the timing belt 27. A linear encoder 28 is provided below the timing belt 27 so as to extend parallel thereto, so that the position of the carriage 21 is detected on the basis of the detection signal from the linear encoder 28.

When a carriage motor (not shown) having the output shaft connected to one of the pulleys 26 rotates in the forward or reverse direction, the timing belt 27 rotates in the forward or reverse direction so as to cause the carriage 21 to reciprocate in the main scanning direction X along the upper and lower rails 31A, 31B. Then a document or an image is recorded on the paper sheet P, by alternately repeating the recording operation of ejecting the ink from the liquid ejecting head 22 onto the paper sheet P while the carriage 21 is moving thereby forming an image corresponding to one line (one path), and the transport of the paper sheet P to the subsequent recording position. In this process, the liquid ejecting head 22 is controlled so as to eject or not to eject the ink with respect to each of the nozzles, according to the position of the carriage 21 detected on the basis of the detection signal from the linear encoder 28.

Figure 4:
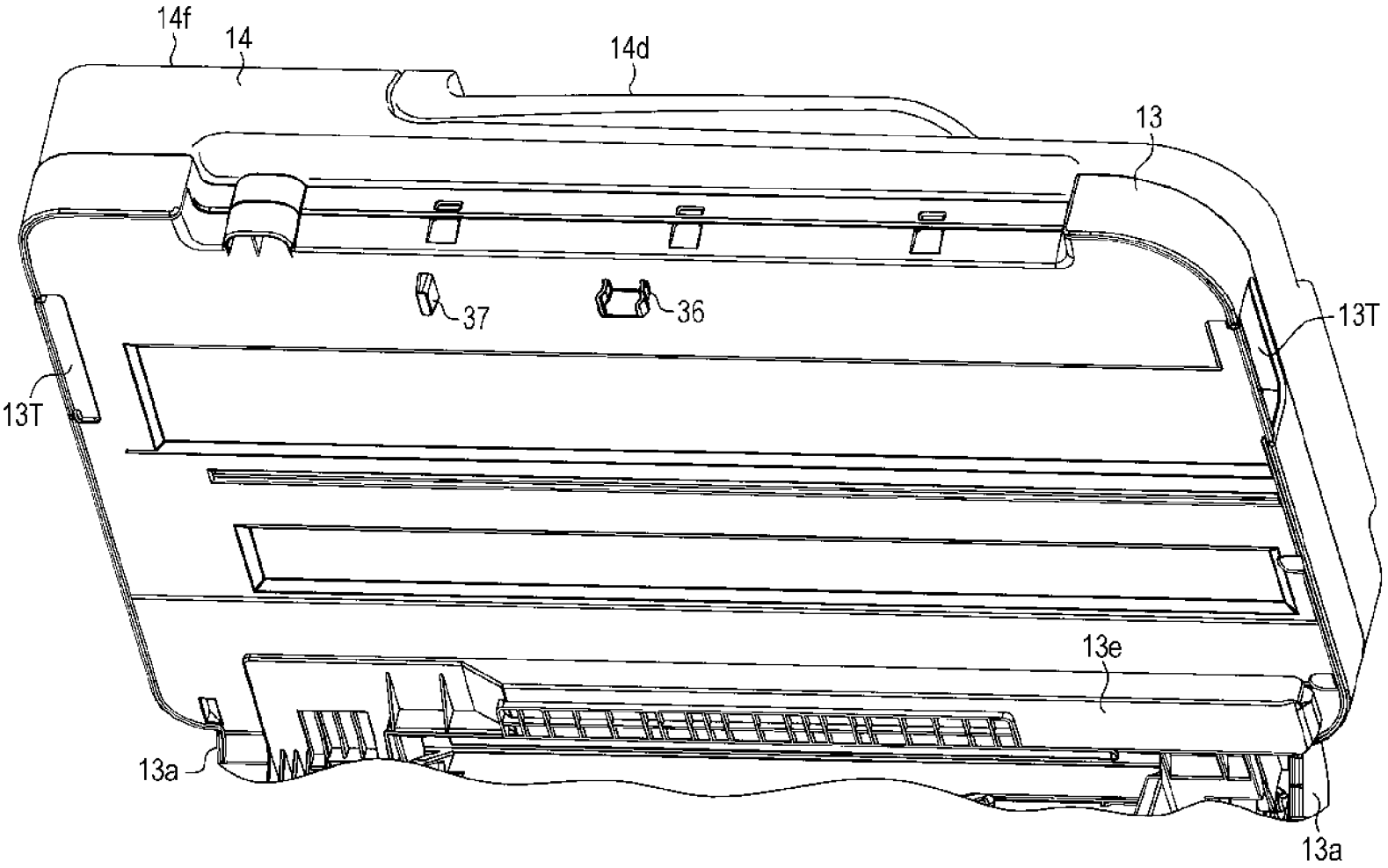
FIG. 4 is a perspective view showing the image reading unit.
Figure 5:
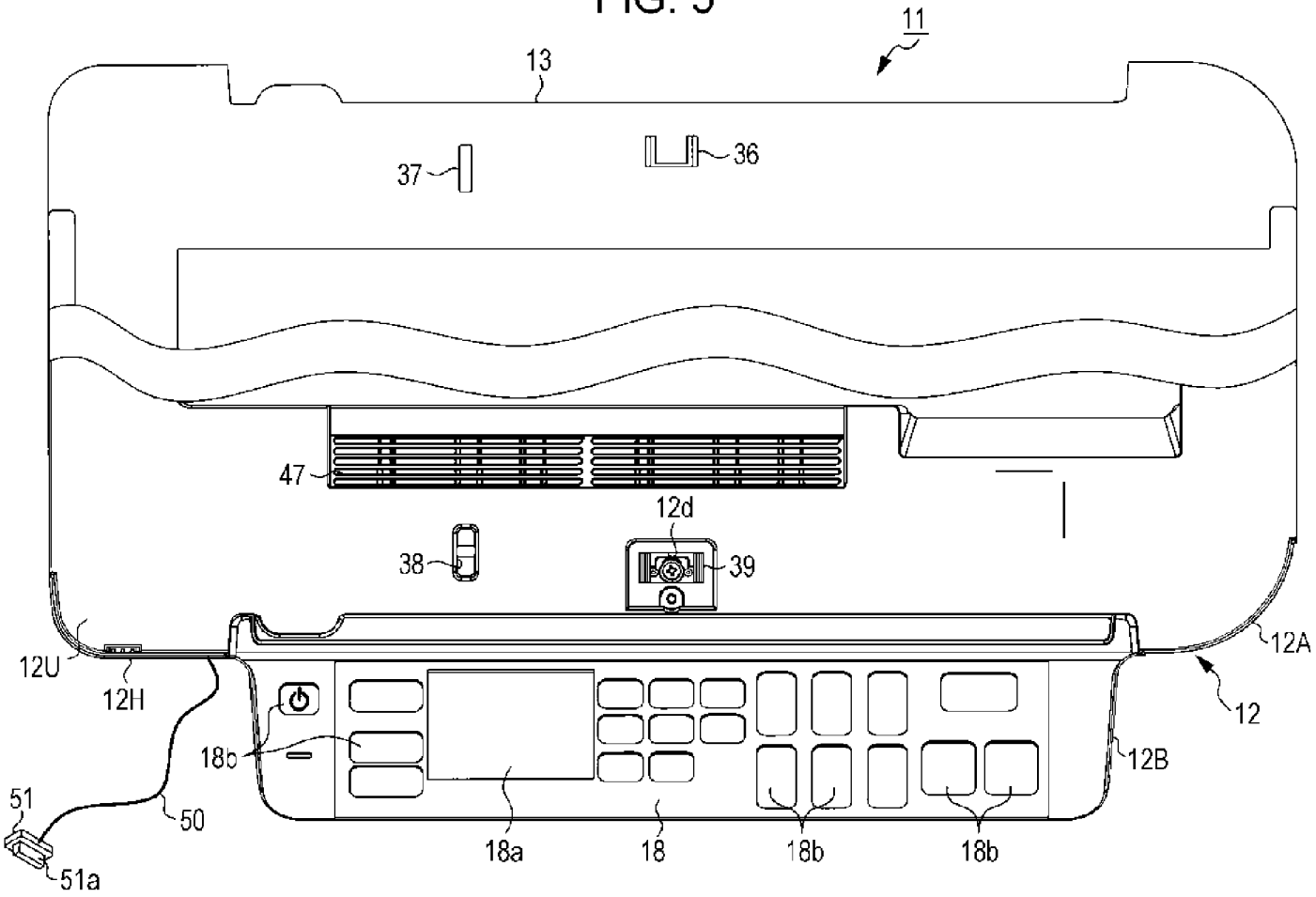
FIG. 5 is a schematic plan view showing correspondences between the upper face of the first printer and the lower face of the image reading unit.

As shown in FIG. 4, the image reading unit 13 includes a slender-shaped protrusion 13*e* that reflects the shape of the groove 13*c*, on the bottom face. The image reading unit 13 also includes, as shown in FIGS. 4 and 5, an engaging projection 36 sticking out from a generally central position in the width direction of the front end portion of the bottom face. The engaging projection 36 is fitted in a mating recess 12*d* formed on the upper face 12U of the apparatus main body 12, when the image reading unit 13 is closed. Here, as shown in FIG. 5, an engaging member 39 to be engaged with the engaging projection 36 is provided inside the mating recess 12*d*.

As shown in FIGS. 4 and 5, further, a projection 37 for activating a sensor 52 is provided at a position spaced to the left from the engaging projection 36 by a predetermined distance in the main scanning direction X. The projection 37 is fitted in a detection recess 38 formed in the upper face of the apparatus main body 12, when the image reading unit 13 is closed. The sensor 52, exemplifying the detector in the invention and configured to detect the projection 37 inserted in the detection recess 38, is provided in the apparatus main body 12 at a position adjacent to the detection recess 38. A controller C provided in the first printer 11 is programmed to permit the instructed printing operation when the image reading unit 13 is detected to be in the closed position by the sensor 52, but to inhibit the printing operation when the closed position of the image reading unit 13 is not detected by the sensor 52.

The ink used by the first printer 11 is supplied to the liquid ejecting head 22 from the ink tanks 19T in an external tank unit 19, through the respective ink supply tubes 40 and adapters AD. The tank unit 19 according to this embodiment includes four ink tanks 19T each containing a different color, such as black (K), cyan (C), magenta (M), and yellow (Y). In the example shown in FIG. 3, one of the four ink tanks 19T containing the black ink, which is most consumed, is a larger tank wider than the remaining ones, which are slightly narrower and respectively contain the color inks.

Likewise, among the adapters AD that can be mounted on the carriage 21, the one for the black ink is thicker and the ones for the color inks are thinner, according to the shape and size of the ink cartridges of the corresponding colors. The carriage 21 includes a plurality (four) of mounting recesses for the ink cartridges, and when the adapters AD are respectively mounted on the mounting recesses, the terminals located on the back face of the respective adapters AD enter into contact with the corresponding terminals of the carriage 21.

Referring again to FIG. 3, the routing arrangement of the ink supply tube 40 will be described. In this embodiment, a spacer 61, exemplifying the gap forming member in the invention and including a recess that allows the ink supply tube 40 to be inserted in a direction intersecting the longitudinal direction, is fixed to the upper face 12U of the apparatus main body 12. The recess serves as an abutment portion.

As shown in FIG. 3, the ink tanks 19T containing the ink supplied to the adapters AD on the carriage 21 are located outside the apparatus main body 12, on the left side thereof when viewed from the front side in the sub scanning direction Y. In other words, the tank unit 19 including the plurality of ink tanks 19T is located outside the stroke region of the carriage 21, on the side opposite to the home position of the carriage 21 in the main scanning direction X. An end portion of each ink supply tube 40, serving as the flow path of the ink stored in the ink tank 19T, is connected to the ink tank 19T. The other end portion of the ink supply tube 40 is inserted in the stroke region of the carriage 21 exposed through an opening 12K formed in the printing functional unit 12A, and connected to the adapter AD mounted on the carriage 21.

To be more detailed, an end portion of the ink supply tube 40 is connected to a delivery tube (not shown) provided in the lower portion of the tank unit 19 so as to communicate with the ink tank 19T, and the other end portion is connected to a supply tube (not shown) located on the upper face of the adapter AD mounted on the carriage 21. The ink supply tube 40 connecting between the tank unit 19 and the adapter AD on the carriage 21 is substantially linearly routed above the opening 12K in the main scanning direction X, through a region close to the rear side of the apparatus main body 12, where the hinge 13*a* pivotally supporting the image reading unit 13 is provided.

As shown in FIG. 3, a slender support plate 41 is spanned over the upper face of the casing 12H, so as to cross the opening 12K in the sub scanning direction Y. The length of the support plate 41 in the sub scanning direction Y is slightly longer than the width of the opening 12K in the sub scanning direction Y. An end portion of the support plate 41 is fixed to the upper face 12U with a fastener or an adhesive (neither shown).

The other end portion of the support plate 41 is fixed to the upper face 12U of the casing 12H with a fastener or an adhesive (neither shown), so as to fix a portion of the ink supply tube 40 in the main scanning direction X. In this embodiment, an adhesive tape is employed to fix the support plate 41. Naturally, a screw or an adhesive may be employed instead.

In a region of the upper face 12U of the casing 12H on the further rear side from the opening 12K, a recess 12*b* is provided at the position corresponding to the protrusion 13*e* reflecting the shape of the groove 13*c* of the image reading unit 13, so that the protrusion 13*e* can be accommodated in the recess 12*b*. In the case where the ink supply tube 40 is routed along the upper face 12U of the casing 12H as in this embodiment, it is preferable that the ink supply tube 40 is routed so as not to interfere with the protrusion 13*e*, in other words not to interfere with the recess 12*b* in which the protrusion 13*e* is accommodated.

In addition, the spacer 61, exemplifying the gap forming member in the invention, is fixed to the upper face 12U of the casing 12H so as to project upward to a predetermined height. The spacer 61 is interposed between the image reading unit 13 and the apparatus main body 12 when the image reading unit 13 is made to pivot so as to close the opening 12K, thus to secure a gap between the apparatus main body 12 and the image reading unit 13 for the ink supply tube 40 to be passed therethrough. The spacer 61 according to this embodiment is a boss having a generally U-shaped cross-section when viewed in an axial direction.

The portion of the ink supply tube 40 in the longitudinal direction, passed through the gap formed by the spacer 61 and supported by the support plate 41, is fixed to the support plate 41 with fasteners 62, 63. In addition, the ink supply tube 40 is composed of a plurality of tubes connected to each other via a joint fitting 40J, and the end portions of the ink supply tubes 40 on the respective sides of the joint fitting 40J are fixed with the fasteners 62, 63.

More specifically, the ink supply tube 40 first extends from the tank unit 19 including a plurality of ink tanks 19T, and is routed in the main scanning direction X from a position on the upper face 12U of the apparatus main body 12 close to the rear end portion on the left side in FIG. 3, where the ink supply tube 40 is retained by the spacer 61 having the U-shaped cross-section. Thus, the ink supply tube 40 is restricted from moving in a direction intersecting the longitudinal direction.

Then the portion of the ink supply tube 40 downstream of the spacer 61 is fixed to the upper face of the support plate 41 with the pair of fasteners 62, 63.

As shown in FIG. 3, further, the portions of the ink supply tubes 40 close to the adapter AD are bundled by a retainer 44 fixed to the right-hand side face of the carriage 21, and the end portions downstream of the position bundled by the retainer 44 are respectively connected to the supply tubes (not shown) on the upper face of the adapters AD.

The portion of the ink supply tube 40 fixed with the fasteners 62, 63 is restricted from moving in the longitudinal direction of the ink supply tube 40, as well as in a direction intersecting the longitudinal direction.

In this embodiment, the portion of the ink supply tube 40 between the fastener 63 on the downstream side and the adapter AD, more accurately the portion between the fastener 63 and the retainer 44 constitutes a flexible movable portion 40H that can be deformed following up the movement of the carriage 21 as shown in FIG. 3. In other words, the tube length of the flexible movable portion 40H is determined according to the position of the downstream fastener 63.

Hereunder, the outline of the flexible movable portion 40H will be described. In FIG. 3, the position of the ink supply tubes 40 taken when the carriage 21 is at the home position is indicated by solid lines, and a curved portion 40C of the ink supply tube 40 formed when the carriage 21 is at the position opposite to the home position is indicated by dash-dot-dot lines. In the example shown in FIG. 3, the plurality of ink supply tubes 40 are radially aligned in a row such that the respective center lines fall on the same plane, thus to form a sheet-like shape. Such plurality of ink supply tubes 40 are curved halfway in an arcuate shape, and the portions (tube faces) on the respective sides of the curved portion 40C extend parallel to each other opposing in the up-down direction. Such a configuration suppresses the ink supply tubes 40 from largely deviating from the predetermined route owing to the displacement of the curved portion 40C following the movement of the carriage 21.

In this embodiment, since the spacer 61 is interposed between the apparatus main body 12 and the image reading unit 13 when the image reading unit 13 is closed, a gap is formed therebetween. Therefore, the projection 37 for activating the sensor 52 is not inserted in the detection recess 38 and hence the sensor 52 is not activated.

Figure 6A:
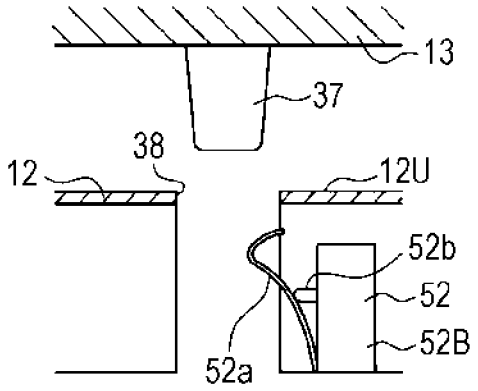
FIGS. 6A and 6B are schematic cross-sectional views for explaining the closed position of an upper structure.
Figure 6B:
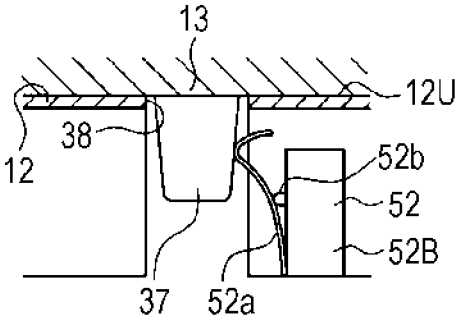

Referring now to FIGS. 6A and 6B, the relationship between the sensor 52 and the projection 37 for activating the sensor 52 will be described.

As shown in FIG. 6A, the sensor 52 is provided adjacent to the lower portion of the detection recess 38. The sensor 52 may be a contact sensor, or a non-contact sensor such as an optical sensor.

The sensor 52 includes a sensor body 52B, and a resilient detection arm 52*a* (for example, a leaf spring) extending upward from a lower portion of the sensor body 52B. The upper end portion of the detection arm 52*a* sticks out into the detection recess 38 by a predetermined amount so as to interfere with the projection 37 when the projection 37 is inserted in the detection recess 38. The sensor body 52B includes a detection element 52*b*, and when the detection arm 52*a* is displaced in a direction opposite to the sticking direction, the detection element 52*b* is pressed by the detection arm 52*a* and thus turns on the sensor body 52B, and turns off the sensor body 52B when the detection arm 52*a* returns to the initial position. Accordingly, when the image reading unit 13 is open and hence the projection 37 is not inserted in the detection recess 38 as shown in FIG. 6A, the detection arm 52*a* remains at the initial position and therefore the sensor 52 is not activated since the detection element 52*b* is not pressed. On the other hand, when the image reading unit 13 is closed and the projection 37 is inserted in the detection recess 38 as shown in FIG. 6B, the detection arm 52*a* is pressed by the projection 37 and displaced toward the sensor body 52B, and therefore the detection element 52*b* is pressed and the sensor 52 is activated. Therefore, the printing operation is inhibited when the image reading unit 13 is open, and permitted when the image reading unit 13 is closed.

Figure 7:
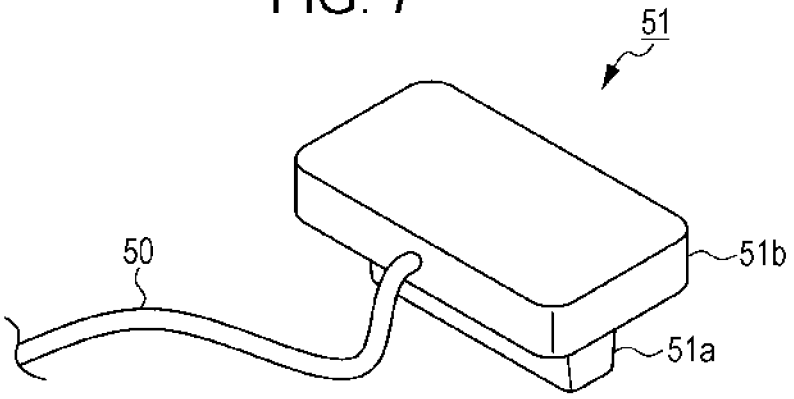
FIG. 7 is a perspective view showing an insertion piece.

FIG. 7 illustrates an insertion piece 51 for activating the sensor 52. As shown in FIG. 7, the insertion piece 51 includes a rectangular plate-shaped base portion 51*b* and a projection 51*a* perpendicularly projecting downward from the central portion of the lower face of the base portion 51*b*. A string 50 is attached to the base portion 51*b*, and the other end of the string 50 is, for example, fixed to the side face or front face of the apparatus main body 12. The projection 51*a* has generally the same shape and size as the projection 37.

Figure 8A:
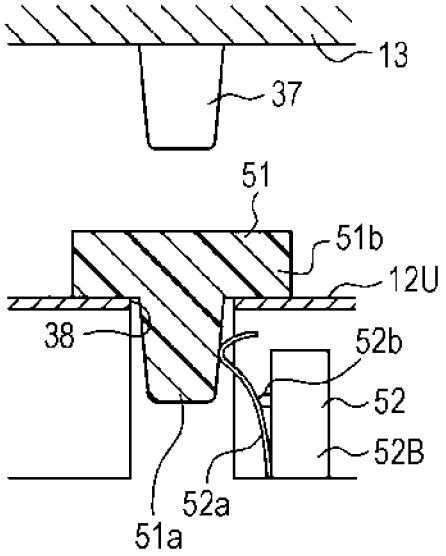
FIGS. 8A and 8B are schematic cross-sectional views for explaining a detection mechanism including the insertion piece.
Figure 8B:
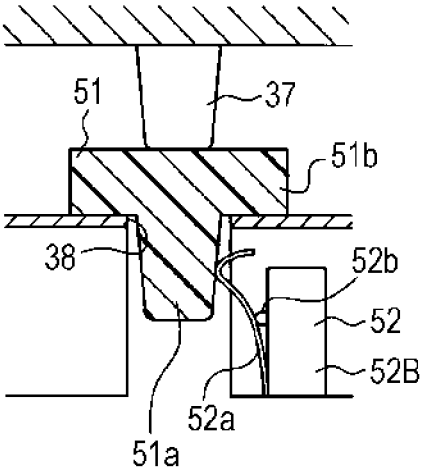

Referring to FIGS. 8A and 8B, the use of the insertion piece 51 will be described. The projection 51*a* of the insertion piece 51 is inserted in the detection recess 38 as shown in FIG. 8A, when the image reading unit 13 is open or unable to be completely closed. When the projection 51*a* is inserted in the detection recess 38 as shown in FIG. 8A, the detection arm 52*a* is pressed by the projection 51*a* and the sensor 52 is activated. When the image reading unit 13 is closed as shown in FIG. 8B, the projection 37 is made to abut the upper face of the insertion piece 51 and thus restricted from moving further downward. However, since the projection 51*a* of the insertion piece 51 is pressing the detection arm 52*a*, the sensor 52 remains activated.

Hereunder, the electrical configuration of the first printer 11 will be described referring to FIG. 9.

Figure 9:
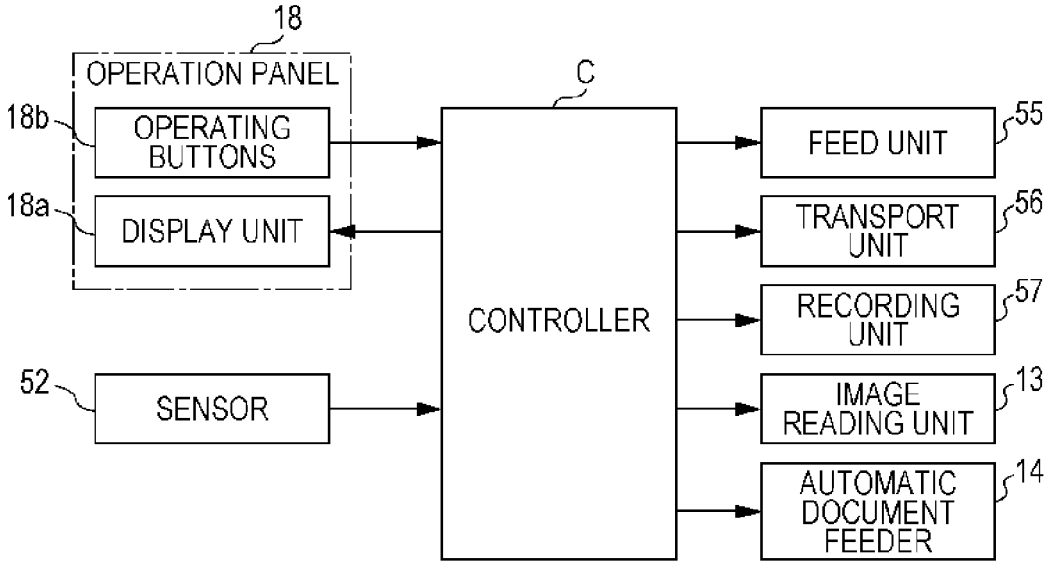
FIG. 9 is a block diagram showing an electrical configuration of the first printer.

As shown in FIG. 9, the first printer 11 includes the controller C that performs various controlling operations. On the input end, the sensor 52 and the operating buttons 18*b* including a power button provided on the operation panel 18 are connected to the controller C. On the output end, the display unit 18*a* on the operation panel 18, a feed unit 55, a transport unit 56, the liquid ejecting head 22, the image reading unit 13, and the automatic document feeder 14 are connected to the controller C. In addition, a sheet sensor and the linear encoder 28 employed for controlling the printing performance, a linear encoder for detecting the rotation of the transport system, and so forth are connected to the controller C. A recording unit 57 includes the liquid ejecting head 22 and the carriage motor (not shown).

As shown in FIG. 9, the controller C controls the action of a carriage motor (not shown) included in the recording unit 57, to thereby control the movement of the carriage 21 in the main scanning direction X. In this process, the controller C counts input pulses from the linear encoder 28 with a counter (not shown), thus to recognize the position of the carriage 21, for example with respect to the home position.

The controller C also controls the feed unit 55 and the transport unit 56. When the feed unit 55 is driven the pickup roller is made to rotate so that the paper sheets P in the sheet cassette 15 are delivered one by one. When the transport unit 56 is driven the transport roller 24 and the discharge roller 25 are made to rotate, so that the paper sheet P is transported and then discharged.

The sensor 52 detects whether the image reading unit 13 is at the closed position. For example, the sensor 52 is turned on when the image reading unit 13 is at the closed position and turned off when the image reading unit 13 is away from the closed position. The controller C permits the instructed printing operation when the sensor 52 detects that the image reading unit 13 is at the closed position, but inhibits the instructed printing operation when the sensor 52 does not detect that the image reading unit 13 is at the closed position.

The controller C controls the liquid ejecting head 22 to cause the liquid ejecting head 22 to eject ink droplets, according to received image data to be printed. The controller C controls the carriage motor so as to control the movement of the carriage 21 in the main scanning direction X. Further, the controller C controls the transport motor to control the delivery and transport of the paper sheet.

The first printer 11 provides the following advantageous effects.

The ink supply tubes 40 are arranged on the upper face 12U of the apparatus main body 12, and the spacer 61 is provided to prevent the ink supply tubes 40 from being flattened. Therefore, the image reading unit 13 is made to abut the spacer 61 and a gap is defined therebetween. At this stage, the image reading unit 13 is slightly lifted because of being detained by the spacer 61. As a result, the projection 37 is kept from being inserted in the detection recess 38.

In this embodiment, however, the projection 51*a* of the insertion piece 51 is inserted in the detection recess 38 as shown in FIG. 8A, and hence the sensor 52 detects the projection 51*a*. Accordingly, the controller C receives the input of the detection signal from the sensor 52. With the detection signal received, the controller C receives the printing job.

Upon receipt of the printing job, the controller C confirms the detection status of the sensor 52, and permits the printing operation in the case where the sensor 52 is turned on. On the contrary, in the case where the insertion piece 51 is not inserted in the detection recess 38, the sensor 52 is turned off and hence the controller C inhibits the printing operation.

As shown in FIG. 3, the image reading unit 13 includes the projection 37 for detection, projecting from a position on the left in the width direction close to the frontal edge. The projection 37 is inserted in the detection recess 38 formed in the upper face of the apparatus main body 12, when the image reading unit 13 is closed. The apparatus main body 12 includes the sensor 52 (see FIGS. 8A and 8B) that detects the projection 37 inserted in the detection recess 38, at the position corresponding to the detection recess 38. The controller C in the first printer 11 permits the instructed printing operation when the sensor 52 detects that the image reading unit 13 is at the closed position, but inhibits the printing operation despite the printing instruction having been received, unless the sensor 52 detects that the image reading unit 13 is at the closed position.

In addition, the insertion piece 51 is connected to a lower position on the front face of the apparatus main body 12 with the string 50, as shown in FIG. 3.

The ink supply tubes 40 extending from the external tank unit 19 are routed along the rear portion of the opening 12K on the upper face of the apparatus main body 12 in the main scanning direction X as shown in FIG. 3, introduced into inside the opening 12K via the right side of the carriage 21 located at the home position, bundled with the retainer 44 and then connected to the respective adapters AD. Accordingly, the ink supply tubes 40 run across the position on the left on the apparatus main body 12 in the width direction and close to the rear end portion thereof, and are retained by the spacer 61 at the crossing position. Therefore, when the image reading unit 13 is closed the lower face thereof is made to abut the spacer 61, and hence slightly lifted by the distance corresponding to the height of the spacer 61.

In the case where the image reading unit 13 is not completely closed because the ink supply tubes 40 are interposed between the apparatus main body 12 and the image reading unit 13, the sensor 52 is unable to detect the projection 37. Therefore, the printing operation is unable to be performed utilizing the external ink tanks 19T. In this embodiment, however, the user can insert the projection 51*a* of the insertion piece 51 connected to the printer, in the detection recess 38. Then the sensor 52 is turned on and the controller C permits the printing operation when the printing instruction from the user is received by the first printer 11, despite the image reading unit 13 being slightly lifted.

Thus, the spacer 61 secures the gap between the apparatus main body 12 and the image reading unit 13 thereby preventing the ink supply tube 40 from being flattened, and also allows the printing operation to be performed.

Second Embodiment

Hereunder, another configuration of the insertion piece, exemplifying the separate member in the invention, will be described referring to FIGS. 10 to 12B. In FIGS. 10 to 12B, the constituents that are the same as those shown in FIGS. 4, 6A, 6B, and 7 are given the same numeral, and the description of those constituents will not be repeated.

Figure 10:
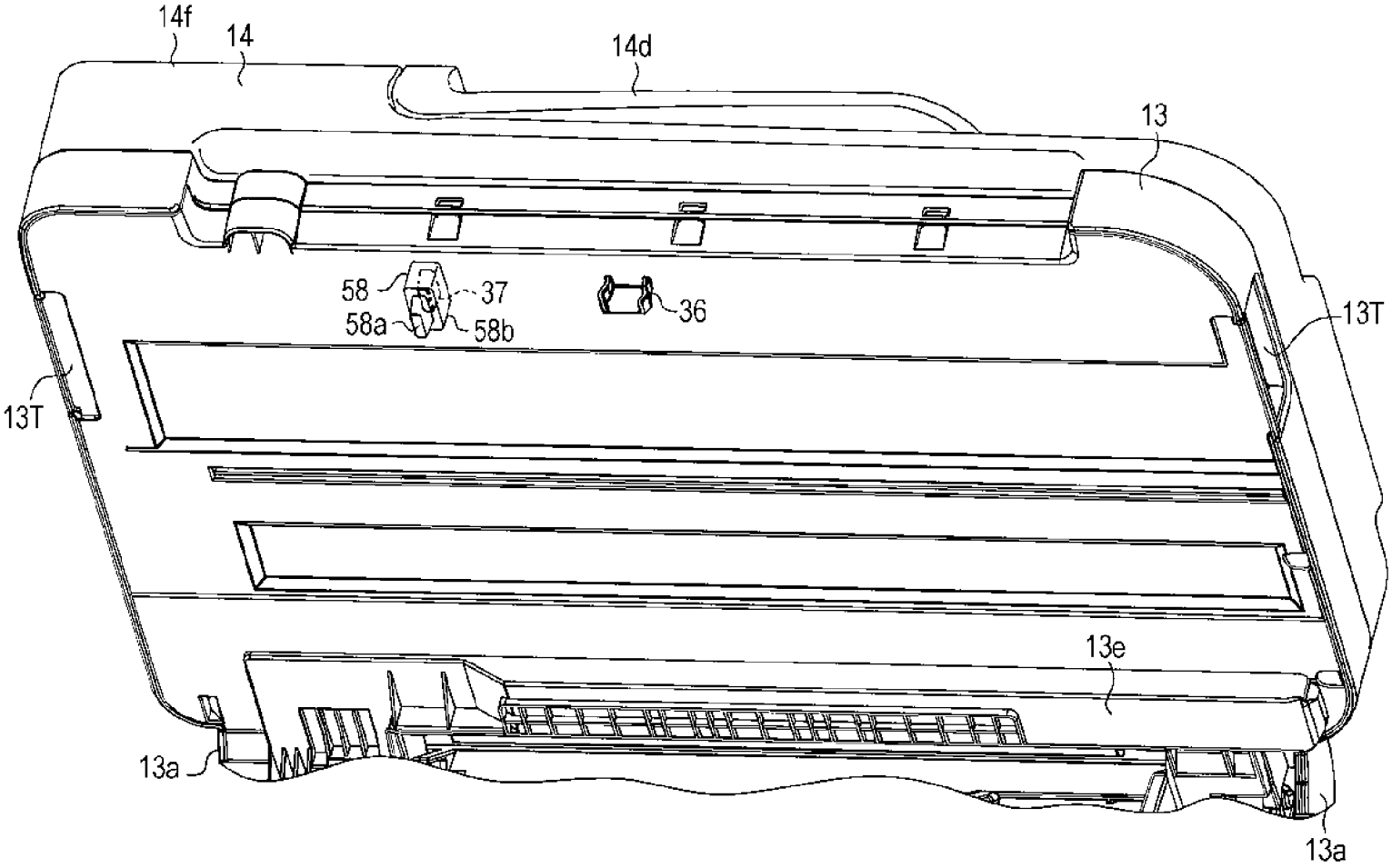
FIG. 10 is a perspective view showing the image reading unit with an attachment according to a second embodiment of the invention.
Figure 11A:
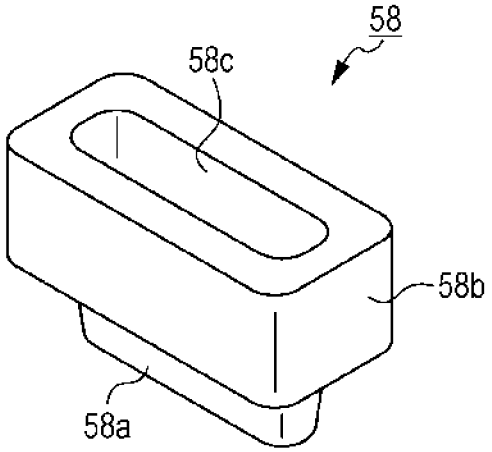
FIGS. 11A and 11B are a perspective view and a front view, respectively, showing the attachment.
Figure 11B:
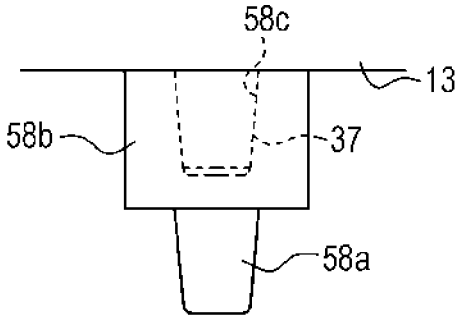
Figure 12A:
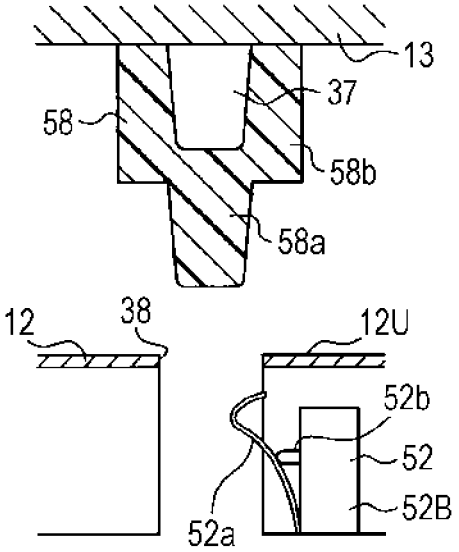
FIGS. 12A and 12B are schematic cross-sectional views for explaining a detection mechanism including the attachment.
Figure 12B:
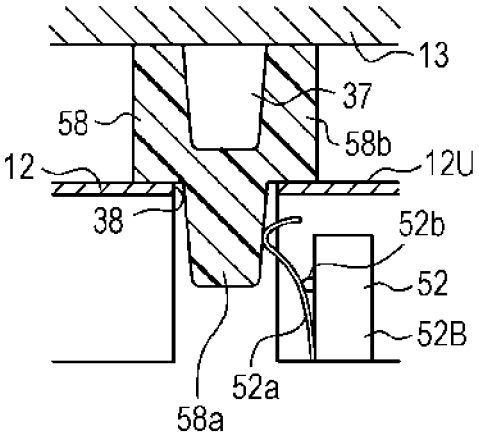

As shown in FIG. 10, the insertion piece is an attachment 58 to be fitted onto the projection 37. The attachment 58 includes, as shown in FIGS. 11A and 11B, a base portion 58*b* and a projection 58*a*, and the base portion 58*b* includes a fitting recess 58*c* formed in the face opposite to the projection 58*a*. The projection 37 is inserted in the fitting recess 58*c* as shown in FIG. 10. Thus, when the image reading unit 13 is closed slightly further from the state shown in FIG. 12A, the sensor 52 can be activated despite the image reading unit 13 being slightly lifted because of the presence of the spacer 61.

Third Embodiment

Figure 13:
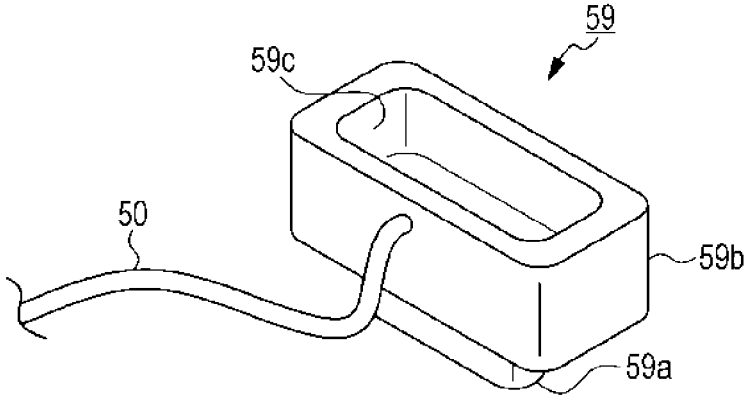
FIG. 13 is a perspective view showing a spacer according to a third embodiment of the invention.
Figure 14:
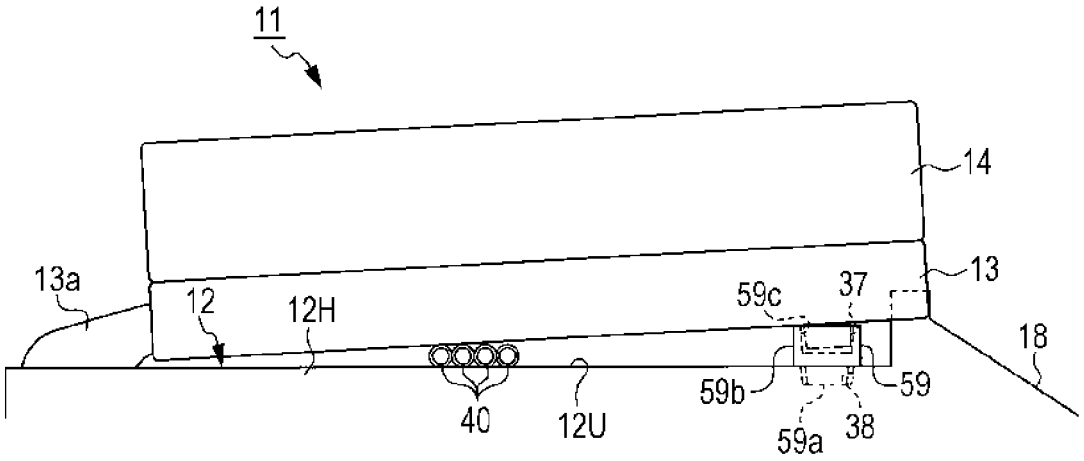
FIG. 14 is a fragmentary side view of the first printer.

Hereunder, still another configuration of the insertion piece will be described referring to FIGS. 13 and 14. In FIGS. 13 and 14, the constituents that are the same as those shown in FIGS. 11A to 12B are given the same numeral, and the description of those constituents will not be repeated.

An insertion piece 59 shown in FIG. 13 is different from the insertion piece 51 according to the first embodiment in thickness of the base portion and in that the insertion piece 59 includes a recess 59*c* formed at the position corresponding to the projection 37. More specifically, the insertion piece 59 includes a base portion 59*b* and a projection 59*a*, as shown in FIG. 13. The base portion 59*b* is relatively thick and serves also as a spacer. The recess 59*c* formed in the base portion 59*b* is considerably larger and deeper than the size of the projection 37.

As shown in FIG. 14, when the upper structure including the image reading unit 13 and the automatic document feeder 14 is closed, the base portion 59*b* serves as a spacer so as to secure a gap of a size that exempts the plurality of ink supply tubes 40 from being flattened, between the apparatus main body 12 and the image reading unit 13. Further, the projection 37 is inserted in the recess 59*c* with a gap from the inner wall of the recess 59*c*. Therefore, even when the projection 37 is only intended to be inserted in the detection recess 38 and hence does not possess significant rigidity, the projection 37 can be protected by being accommodated in the recess 59*c* and, for example, prevented from being broken.

The first to the third embodiments provide the following advantageous effects.

Since the sensor 52 is activated by inserting the insertion piece 51, the printing operation can be performed although the ink supply tubes 40 and the spacer 61 restrict the image reading unit 13 from being completely closed. Therefore, the first printer 11 can perform the printing operation with the ink supplied from the external ink tanks 19T.

Providing the spacer 61 (exemplifying the gap forming member) between the housing and the upper structure facilitates the liquid supply tube to be routed without the liquid flow path being blocked, thus allowing the liquid to be supplied to the liquid ejecting head without the need to disconnect the end portion of the liquid supply tube.

The printing operation (liquid ejecting operation) of the liquid ejecting head is permitted in the case where the sensor 52 (exemplifying the detector) detects that the image reading unit 13 is at the closed position. Otherwise, the liquid ejecting operation of the liquid ejecting head 22 is not permitted. However, the sensor 52 can be activated by inserting the insertion piece in the detection recess, despite the image reading unit 13 being unable to be completely closed because of the ink supply tubes 40 provided along the route from the ink tanks 19T through the opening, and therefore the liquid ejecting head 22 can be permitted to perform the printing operation even though the upper structure is not closed.

The first printer 11 includes the spacer 61 that forms a gap between the casing 12H and the image reading unit 13 exemplifying the upper structure, when the image reading unit 13 is displaced toward the opening 12K.

With the mentioned configuration, although the upper structure is unable to be set to the closed position owing to the gap formed by the gap forming member between the housing and the upper structure when the upper structure is displaced toward the opening, the liquid ejecting operation can be performed by inserting the separate member in the detection recess.

In the first embodiment, the separate member in the invention is exemplified by the insertion piece including the projection having generally the same shape and size as the detection activator. Since the insertion piece includes the projection having generally the same shape and size as the projection 37 (exemplifying the detection activator), the liquid ejecting operation can be performed by inserting the projection of the insertion piece in the detection recess, despite the image reading unit 13 not being set to the closed position.

In the second embodiment, the attachment to be fitted to the detection activator is employed as the separate member. Upon closing the upper structure with the attachment fitted to the detection activator, the attachment is inserted in the detection recess and hence the detector is activated. Therefore, the liquid ejecting operation can be performed despite the upper structure not being completely closed.

The separate member is configured so as to activate the detector at an aperture of the upper structure larger than an aperture at which the detection activator is in the detection range, and to partially overlap the aperture corresponding to the detection range of the detection activator.

With such a configuration, since the aperture of the upper structure and the detection range partially overlap, the detector can be activated even when the upper structure is slightly opened to an extent that the detection activator is unengaged with the detection element.

The separate member includes the projection that can be inserted in the recess and the base portion unable to be inserted in the recess. Therefore, the detector can be activated upon inserting the projection 37 in the detection recess 38, and the base portion serves as a spacer.

The upper structure is the image reading unit 13 configured to read a source document, and the liquid supply tubes are routed so as not to interfere with the protrusion formed on the image reading unit 13.

With the mentioned configuration, since the liquid supply tubes are routed so as not to interfere with the protrusion on the lower face of the image reading unit 13, the liquid supply tubes are prevented from being caught by the protrusion when the image reading unit 13 is closed. In this case, since the liquid supply tubes are exempted from being pressed by the protrusion, the liquid flow in the liquid supply tubes can be prevented from being disturbed at the position that would otherwise be pressed.

Connecting the plurality of tubes via the joint fitting 40J allows the ink supply tube 40 to be adjusted to an appropriate length for the routing.

Since the ink tanks 19T are located outside the apparatus main body 12 (printing functional unit 12A), the restriction on the storage amount of ink is mitigated. Therefore, a larger amount of ink can be stored in the ink tanks 19T.

The joint portion of the tubes connected via the joint fitting 40J is located at a position other than the flexible movable portion 40H of the ink supply tube 40. Such a configuration keeps the joint portion of the ink supply tubes 40 connected via the joint fitting 40J away from the curved portion 40C, thereby preventing the tubes from coming off from the joint fitting 40J.

One or a plurality of ink supply tubes can be provided, and therefore the ink can be supplied to the liquid ejecting head 22 through an appropriate number of ink supply tubes 40 according to the number of the ink tanks 19T, from the respective ink tanks 19T.

In the case where a plurality of ink tanks 19T are provided and the plurality of ink supply tubes 40 are arranged according to the number of ink tanks 19T, the plurality of color inks can be supplied to the liquid ejecting head 22 through the respective ink supply tubes 40 and the adapters AD, to perform the color printing.

The increase in size (foot print) of the first printer 11 is suppressed to a certain extent, despite the sheet cassette 15 being set flush with the front face of the accommodation region 12S corresponding to the projecting portion of the housing, so as to allow the paper sheet P to be delivered from the front side of the apparatus main body 12. In addition, the base portion 12B of the operation panel 18 is constituted of a portion of the housing having a sloped surface formed such that the lower portion sticks out in the discharge direction of the paper sheet P (sub scanning direction Y) with respect to the upper portion. The display unit 18*a* (for example, an LCD panel) and the operating buttons 18*b* are attached to the sloped surface of the base portion 12B. Therefore, the visibility of the display unit 18*a* and the operability of the operating buttons 18*b* can be sufficiently secured.

Fourth Embodiment

Figure 15:
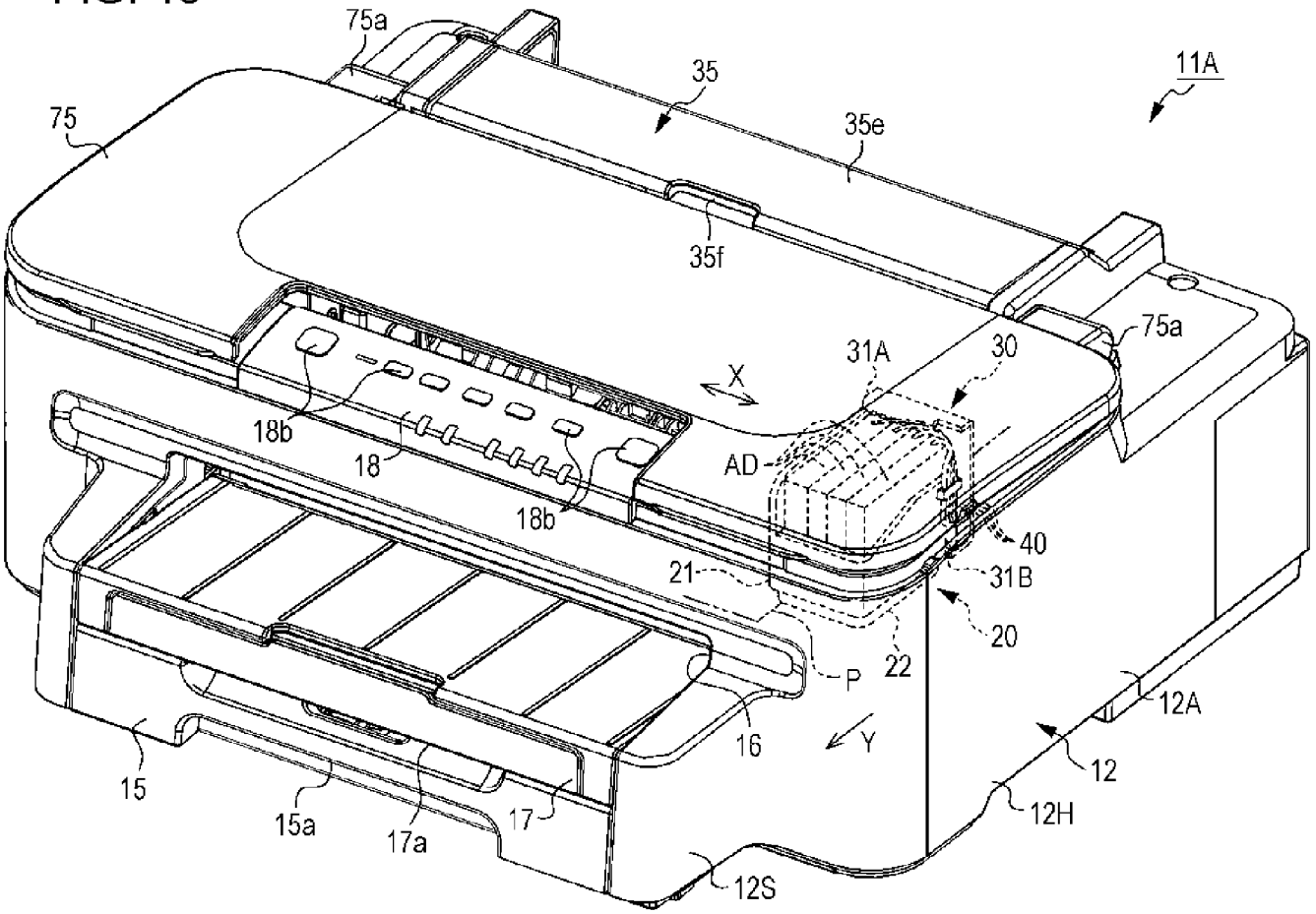
FIG. 15 is a perspective view showing a second printer according to a fourth embodiment of the invention.
Figure 16:
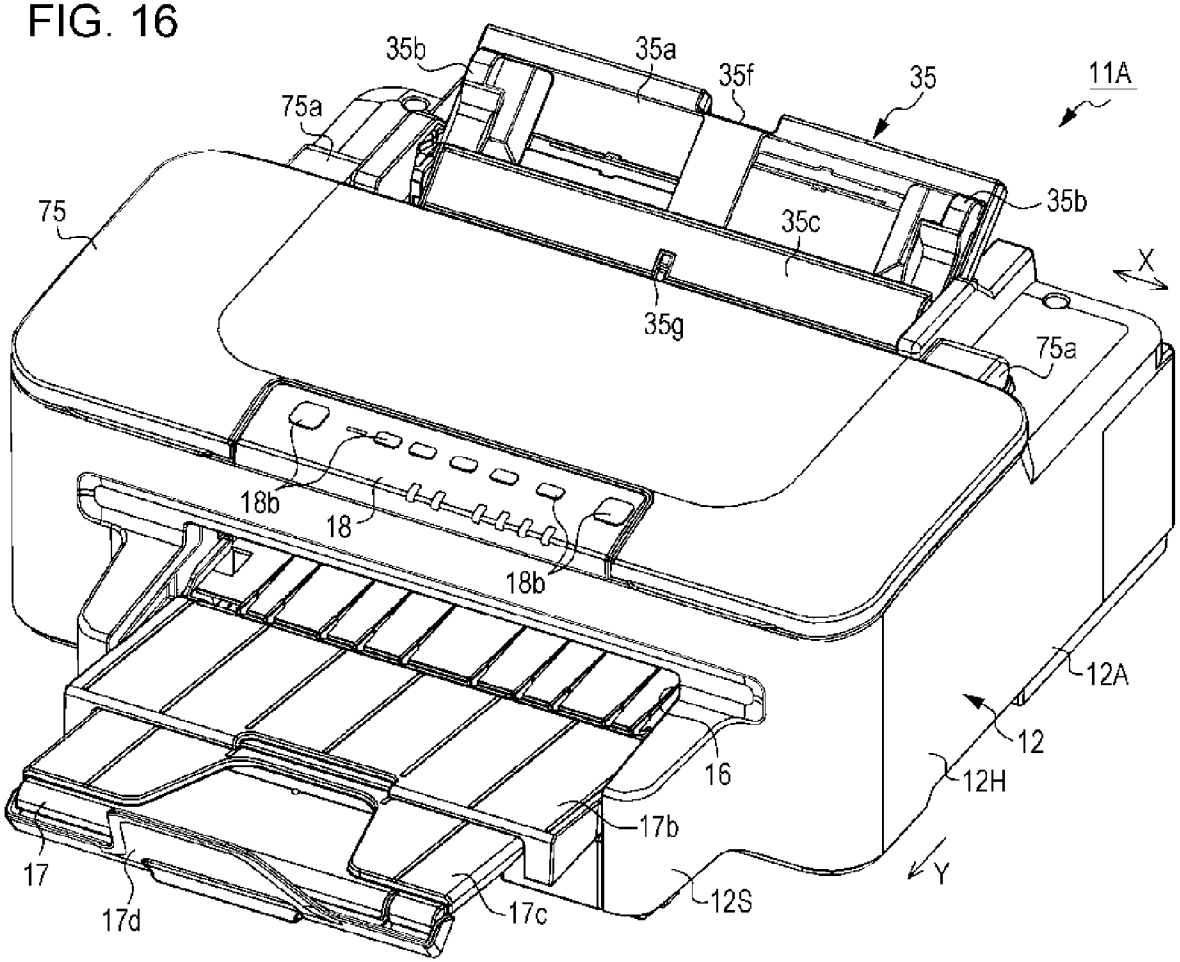
FIG. 16 is a perspective view showing the second printer with the stacker and the manual feed mechanism set to the open position.
Figure 17:
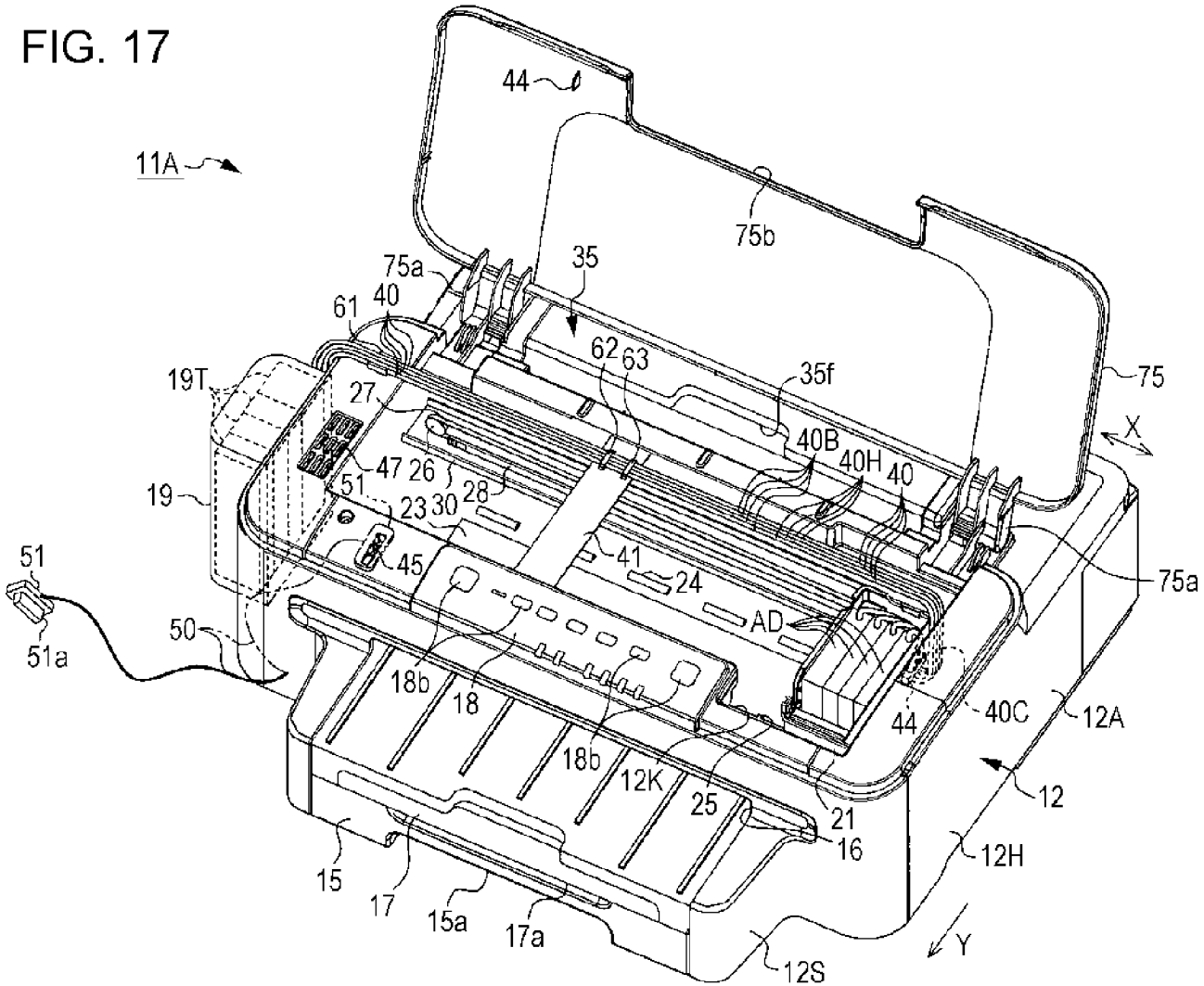
FIG. 17 is a perspective view showing the second printer with the top cover set to the open position.

Referring now to FIGS. 15 to 17, a configuration of a second printer 11A without the image reading function will be described hereunder. Unlike the first and the second embodiment, in which the first printer 11 is a so-called multifunction printer, the second printer 11A according to this embodiment only includes the printing functional unit (printer unit), without the image reading unit. In FIGS. 15 to 17, the constituents that are the same as those shown in FIGS. 1 to 3 are given the same numeral, and the description of those constituents will not be repeated.

As shown in FIG. 15, the second printer 11A according to this embodiment includes a printing functional unit 12A capable of performing the printing operation, constituting a part of the apparatus main body 12. second printer 11A receives the ink from the ink tanks 19T (see FIG. 17) exemplifying the liquid chamber, which are independent from the apparatus main body 12 and have a generally rectangular block shape. Thus, the ink stored in the ink tanks 19T, located outside the apparatus main body 12, is supplied to inside of the apparatus main body 12 through the ink supply tubes 40 (see FIG. 17).

The apparatus main body 12 of the second printer 11A includes the casing 12H containing the printing unit 20. A top cover 75, another example of the upper structure, is disposed so as to pivot (be displaced) about a hinge 75*a* provided on an end portion (rear end) of the apparatus main body 12, such that the front end portion of the top cover 75 opposite to the hinge 75*a* is lifted up. Accordingly, the user of the second printer 11A can lift the top cover 75, for example for a maintenance job. When the top cover 75 is thus lifted, an opening 12K (see FIG. 17) is exposed, in which at least a part of the stroke region of the carriage 21, provided above the printing unit 20 and set to reciprocate inside the printing functional unit 12A, is exposed.

Further, as shown in FIGS. 15 and 16, apparatus main body 12 includes the manual feed mechanism 35 located behind the top cover 75. The manual feed mechanism 35 can be opened and closed by making a cover 35*e* that also serves as the sheet tray 35*a* (see FIG. 16) pivot about the rear edge, and the cover 35*e* is set to the closed position as shown in FIG. 15, when the manual feed mechanism 35 is not in use. The cover 35*e* includes a recessed grab portion 35*f* located at the front end portion when the cover 35*e* is closed, and the user can hold the grab portion 35*f* to flip the cover 35*e* backward, to thereby set the cover 35*e* to the open position for use, in which the sheet tray 35*a* is obliquely erected (see FIG. 16). The open position of the manual feed mechanism 35 will be subsequently described.

In addition, a sheet cassette 15 in which a plurality of paper sheets P can be stacked is removably mounted in the lower portion of the apparatus main body 12. The paper sheets P placed in the sheet cassette 15 are fed one by one in the forward direction from a rear position, to the printing unit 20 installed inside the printing functional unit 12A, so that the printing unit 20 performs the printing operation on the paper sheets P thus delivered. The configuration of the printing unit 20 is generally the same as that of the first printer 11 according to the first embodiment. The paper sheet P that has undergone the printing operation by the printing unit 20 is discharged through the sheet outlet 16 provided on the front face of the apparatus main body 12 (printing functional unit 12A).

A stacker 17, exemplifying the output tray in the invention, that receives the paper sheet P discharged through the sheet outlet 16 is mounted in the apparatus main body 12 (printing functional unit 12A), above the sheet cassette 15 and under the sheet outlet 16. The stacker 17 is drawn out, when put to use, from the apparatus main body 12 in the discharge direction (transport direction) of the paper sheet P, by a length according to the size of the paper sheet P to be discharged.

As shown in FIG. 15, the accommodation region 12S including the cavity at the central portion thereof in the width direction, in which the sheet cassette 15 and the stacker 17 are to be mounted, is formed of a portion of the casing 12H protruding in the discharge direction of the paper sheet P (sub scanning direction Y). It is because the sheet cassette 15 requires a longer distance in the casing 12H in the sub scanning direction Y than does the printing unit 20, that the accommodation region 12S includes such a protruding portion. Accordingly, the sheet cassette 15 and the stacker 17 are mounted in the accommodation region 12S such that the respective front faces become flush with each other, and so as to protrude from the apparatus main body 12 in the sub scanning direction Y (forward direction). Here, in the case where the length of the apparatus main body 12 in the sub scanning direction Y is determined according to the length of the sheet cassette 15 in the sub scanning direction Y required for accommodating the paper sheet P of a predetermined size, for instance A4 size, the apparatus main body 12 inevitably becomes larger in size, resulting in an increase in foot print. Therefore, to minimize such an increase in size to a possible extent, only the portion corresponding to the region for accommodating the sheet cassette 15 is made to protrude. In other words, the respective sides of the accommodation region 12S are scraped off so as to suppress the increase in size (foot print) of the second printer 11A. In addition, the front face of the stacker 17 is flush with the protruding front face of the sheet cassette 15, and hence a relatively long protruding length is secured for drawing out the stacker 17. The stacker 17 includes the grab portion 17*a*, which further facilitates the stacker 17 to be drawn out from the apparatus main body 12. Thus, the increase in size (foot print) of the second printer 11A is suppressed to a certain extent, despite the sheet cassette 15 being removably mounted from the front side of the apparatus main body 12 so as to allow the paper sheet P to be delivered from the front side of the apparatus main body 12.

As shown in FIG. 15, the operation panel 18 for executing various operations, including causing the printing unit 20 to perform the printing, is provided on the upper face of the apparatus main body 12 (printing functional unit 12A). The operation panel 18 is constituted of a portion of the casing having a sloped surface formed such that the lower portion sticks out in the discharge direction of the paper sheet P (sub scanning direction Y) with respect to the upper portion. The operating buttons 18*b* are provided on the sloped surface of the operation panel 18. The operating buttons 18*b* include, for example, a power button, and a printing execution button. Thus, since the operation panel 18 is provided on the sloped surface downwardly inclined toward the user, the operability of the operating buttons 18*b* can be sufficiently secured.

As shown in FIG. 16, the manual feed mechanism 35 is provided on the rear side of the apparatus main body 12 (printing functional unit 12A). The manual feed mechanism 35 serves to feed a paper sheet P manually set by the user. The manual feed mechanism 35 includes the sheet tray 35*a* of a generally rectangular plate shape, the pair of sheet guides 35*b* to be manipulated for positioning the paper sheet P on the sheet tray 35*a* in the width direction, and the cover plate 35*c* for preventing a foreign substance from dropping into a sheet inlet (not shown) when the manual feed mechanism 35 is open. The sheet tray 35*a* is set to pivot in a predetermined angular range about the base edge thereof (lower edge in FIG. 16), to be set to the open position in which the sheet tray 35*a* is inclined for receiving the paper sheet P as shown in FIG. 17, and the closed position in which the sheet tray 35*a* is accommodated in the apparatus main body 12 by being made to pivot forward in FIG. 17. The cover plate 35*c* is biased toward the sheet tray 35*a* by an elastic force of a coil spring 35*g*, and when the sheet tray 35*a* is opened the cover plate 35*c* is set to the protection position shown in FIG. 16 for preventing a foreign substance that has dropped to the opened region from intruding in the sheet inlet.

The stacker 17 is, for example, composed of three levels including a first tray 17*b*, a second tray 17*c*, and a third tray 17*d*, as shown in FIG. 16. The first tray 17*b* is slidably connected to the apparatus main body 12, and the second tray 17*c* is slidably connected to the first tray 17*b*. The third tray 17*d* is pivotably connected to the front edge of the second tray 17*c*, to be set to a closed position in which the third tray 17*d* is accommodated in the second tray 17*c* so as to overlap, and an open position in which the third tray 17*d* is lifted at a predetermined angle as shown in FIG. 16 so as to serve as a stopper of the paper sheet P.

The ink supply tubes 40 extending from the external ink tanks 19T are introduced onto the upper face of the casing 12H, retained by the spacer 61, and fixed with the fasteners 62, 63 to the support plate 41 spanned over the opening 12K. Although not shown in FIG. 17, a plurality of tubes are connected to each other between the fasteners 62, 63, via the joint fitting 40J similar to those of the first embodiment.

The second printer 11A according to the fourth embodiment provides the following advantageous effects.

As shown in FIG. 17, the top cover 75 includes the projection 37 for detection, projecting from a position on the left in the width direction close to the frontal edge. The projection 37 is inserted in the detection recess 38 formed in the upper face of the apparatus main body 12, when the top cover 75 is closed. The apparatus main body 12 includes the sensor 52 (see FIGS. 8A and 8B) that detects the projection 37 inserted in the detection recess 38, at the position corresponding to the detection recess 38. The controller C in the second printer 11A permits the instructed printing operation when the sensor 52 detects that the top cover 75 is at the closed position, but inhibits the printing operation despite the printing instruction having been received, unless the sensor 52 detects that the image reading unit 13 is at the closed position.

The second printer 11A according to this embodiment also includes, as shown in FIG. 17, the insertion piece 51 connected to a lower portion of the front face of the apparatus main body 12 with the string 50.

The ink supply tubes 40 extending from the external tank unit 19 are routed along the rear portion of the opening 12K on the upper face of the apparatus main body 12 in the main scanning direction X as shown in FIG. 17, introduced into inside the opening 12K via the right side of the carriage 21 located at the home position, bundled with the retainer 44 and then connected to the respective adapters AD. Accordingly, the ink supply tubes 40 run across the position on the left on the apparatus main body 12 in the width direction and close to the rear end portion thereof, and are retained by the spacer 61 at the crossing position. Therefore, when the top cover 75 is closed the lower face thereof is made to abut the spacer 61, and hence slightly lifted by the distance corresponding to the height of the spacer 61.

In the case where the top cover 75 is not completely closed because the ink supply tubes 40 are interposed between the apparatus main body 12 and the top cover 75, the sensor 52 is unable to detect the projection 37. Therefore, the printing operation is unable to be performed utilizing the external ink tanks 19T. In this embodiment, however, the user can insert the projection 51*a* of the insertion piece 51 connected to the printer, in the detection recess 38. Then the sensor 52 is turned on and the controller C permits the printing operation when the printing instruction from the user is received by the second printer 11A, despite the top cover 75 being slightly lifted.

Thus, the spacer 61 secures the gap between the apparatus main body 12 and the top cover 75 thereby preventing the ink supply tube 40 from being flattened, and also allows the printing operation to be performed.

As described above, the second printer 11A according to the fourth embodiment equally provides the advantageous effects that can be obtained from the first to the third embodiments.

The foregoing embodiments may be modified as follows.

The member to be displaced in the detector (sensor), such as the detection arm engaged with the detection element, may be configured to be displaced by the detection activator inserted in the path for detection such as the recess in a direction parallel, orthogonal, or oblique with respect to the axial line of the recess, provided that the detector is configured to detect the insertion of the detection activator in the recess. The detection element may be, for example, a press-down switch to be pressed downward in a direction generally the same as the insertion direction of the detection activator.

In the first embodiment, another gap forming member to be made to contact the outer surface of the ink supply tubes 40 to restrict the movement of the ink supply tubes 40 may be employed, in addition to the spacer 61 forming a gap between the printing functional unit 12A and the image reading unit 13.

In the foregoing embodiments, the adapters AD on the carriage 21 may be excluded. In other words, the ink introduced from the ink tank 19T provided outside the printing functional unit 12A through the ink supply tube 40 may be supplied to the liquid ejecting head 22 without the intermediation of the adapter AD.

In the foregoing embodiments, the ink tank 19T may be attached to the apparatus main body 12 (printing functional unit 12A) or the image reading unit 13 with a fastening member such as a screw or an adhesive. Naturally, the ink tank 19T may be attached to the left or right side face or the rear face of the apparatus main body 12 or the image reading unit 13, in a view from the front side in the sub scanning direction Y. Alternatively, the ink tank 19T may be attached to the upper face of the automatic document feeder 14.

In the foregoing embodiments, a part of the liquid chamber may be placed inside of the liquid ejecting apparatus, and another part may be located outside of the liquid ejecting apparatus.

In the foregoing embodiments, the ink tank 15 may be of a refillable type that can be refilled with the ink, or may be provided with a replaceable pack containing the ink.

In the foregoing embodiments, the liquid chamber may be integrally fixed to the liquid ejecting apparatus, or located away from the liquid ejecting apparatus.

In the foregoing embodiments, the target may be a cloth, a resin film, a resin sheet, or a metal sheet, without limitation to the paper sheet.

The liquid ejecting apparatus according to the foregoing embodiments may be configured to eject or dispense a liquid other than the ink. The form of minute droplets dispensed from the liquid ejecting apparatus may be of a particle shape, a tear-drop shape, or a shape with a thread-like trailing tail. The term "liquid" herein referred to implies those that can be ejected from the liquid ejecting apparatus. For example, substances in the liquid phase may be employed, such as a fluid having high or low viscosity, a sol, a gel, an organic or inorganic solvent, a solution, a liquid resin, or a liquid metal (metal melt). Further, in addition to the substances in the liquid phase, a liquid containing, dispersed or dissolved, dispersed, or mixed therein, functional particles formed of a solid pigment or metal particles may be employed. The ink and the liquid crystal referred to above are typical examples of the liquid. Here, the term "ink" broadly implies, in addition to popular water-based ink and oil-based ink, various liquid compounds such as a gel ink and a hot-melt ink. Specific examples of the liquid ejecting apparatus include those that eject a liquid containing, dispersed or dissolved therein, an electrode material or a color material for manufacturing LCDs, electroluminescence displays, field emission displays, and color filters. Examples of the liquid ejecting apparatus further include those that eject a bioorganic substance for manufacturing biochips, those employed as a precision pipette that ejects a liquid that serves as a specimen, a printing machine, and a micro dispenser. In addition, the invention is also applicable to liquid ejecting apparatuses that eject a lubricant in a pinpoint manner to a precision instrument such as a watch or a camera, those that eject a clear resin fluid such as a UV-curable resin onto a substrate for manufacturing a micro hemispherical lens (optical lens) employed in an optical communication element, and those that eject an acid or alkali etching solution for etching of a substrate or the like.

The entire disclosure of Japanese Patent Application No. 2012-179089, filed Aug. 10, 2012 is expressly incorporated by reference herein.

What is claimed is:

1. A liquid ejecting apparatus comprising:

a liquid ejecting head that ejects a liquid onto a target;

a casing in which a carriage having the liquid ejecting head mounted thereon is set to reciprocate, the casing including an opening in which at least a part of the stroke region of the carriage is exposed;

a cover structure to be displaced with respect to the casing so as to open and close the opening;

a liquid chamber containing the liquid and located outside the casing;

a liquid supply tube extending from the liquid chamber through the opening, and which supplies the liquid to the liquid ejecting head;

a recess formed in the casing;

a detector which is activated by being pressed by an object inserted into the recess;

a control unit which performs a recording operation on the target by controlling the liquid ejection head when the detector is pressed by the object and which does not perform recording on the target by controlling the liquid ejecting head when the detector is not pressed by the object; and a gap forming member which is provided at least partially in the recess and which forms a gap between the casing and the cover structure that allows the liquid supply tube to be passed through the gap without a liquid flow path inside the liquid supply tube being blocked while pressing the detector.

2. A liquid ejecting apparatus according to claim 1, wherein the cover structure includes a projection, the projection being in contact with the gap forming member.

3. A liquid ejecting apparatus comprising:

a liquid ejecting head that ejects a liquid onto a target;

a casing in which a carriage having the liquid ejecting head mounted thereon is set to reciprocate, the casing including an opening in which at least a part of the stroke region of the carriage is exposed;

a cover structure to be displaced with respect to the casing in a direction to open or close the opening;

a liquid chamber containing the liquid and located outside the casing;

a liquid supply tube extending from the liquid chamber through the opening, and which supplies the liquid to the liquid ejecting head;

a recess formed in the casing; a detector which is activated upon being pressed by an object inserted in the recess;

a control unit which performs recording on the target by controlling the liquid ejecting head when the detector is pressed by the object and which does not perform recording on the target by controlling the liquid ejecting head when the detector is not pressed by the object a gap forming member which is provided on the cover structure and which forms a gap between the casing and the cover structure that allows the liquid supply tube to be passed through the gap without a liquid flow path inside the liquid supply tube being blocked while pressing the detector.

4. A liquid ejecting apparatus according to claim 3, wherein the cover structure includes a projection, the gap forming member including a fitting recess in which the projection is fitted and the gap forming member being attached to the projection by the protrusion which is fitted in the fitting recess.

5. A liquid ejecting apparatus comprising:

a liquid ejecting head that ejects a liquid onto a target;

a casing in which a carriage having the liquid ejecting head mounted thereon is set to reciprocate, the casing including an opening in which at least a part of the stroke region of the carriage is exposed;

a cover structure to be displaced with respect to the casing so as to open and close the opening;

a liquid chamber containing the liquid and located outside the casing;

a liquid supply tube extending from the liquid chamber through the opening, and which supplies the liquid to the liquid ejecting head;

a recess formed in the casing;

a detector which is activated upon being pressed by an object inserted in the recess;

a gap forming member which is provided at least partially in the recess and which forms a gap between the casing and the cover structure that allows the liquid supply tube to be passed through the gap without a liquid flow path inside the liquid supply tube being blocked while pressing the detector wherein the liquid ejecting head performs recording on the target when the cover structure is open and closed.

6. The liquid ejecting apparatus according to claim 5, wherein the cover structure includes an image reading unit configured to read a source document, and the liquid supply tube is routed so as not to interfere with a protruding portion formed on the lower face of the image reading unit.

7. The liquid ejecting apparatus according to claim 5, wherein the liquid supply tube is composed of a plurality of tubes connected to each other via a joint fitting.

8. The liquid ejecting apparatus according to claim 5, comprising one or a plurality of the liquid supply tubes.

9. A liquid ejecting apparatus according to claim 5, wherein the cover structure includes a projection and the projection is in contact with the gap forming member.

10. A liquid ejecting apparatus according to claim 5, wherein the gap forming member, when pressing the detector, has an engaging portion for engaging an edge of the recess.

11. A liquid ejecting apparatus comprising:

a liquid ejecting head that ejects a liquid onto a target;

a casing in which a carriage having the liquid ejecting head mounted thereon is set to reciprocate, the casing including an opening in which at least a part of the stroke region of the carriage is exposed;

a cover structure to be displaced with respect to the casing so as to open and close the opening;

a liquid chamber containing the liquid and located outside the casing;

a liquid supply tube extending from the liquid chamber through the opening, and which supplies the liquid to the liquid ejecting head;

a recess formed in the casing;

a detector which is activated upon being pressed by an object inserted in the recess;

a gap forming member which is provided on the cover structure and which form a gap between the casing and the cover structure that allows the liquid supply tube to be passed through the gap without a liquid flow path inside the liquid supply tube being blocked while pressing the detector wherein the liquid ejecting head performs recording on the target when the cover is open and closed.

12. The liquid ejecting apparatus according to claim 11, wherein the cover structure includes an image reading unit configured to read a source document, and the liquid supply tube is routed so as not to interfere with a protruding portion formed on the lower face of the image reading unit.

13. The liquid ejecting apparatus according to claim 11, wherein the liquid supply tube is composed of a plurality of tubes connected to each other via a joint fitting.

14. The liquid ejecting apparatus according to claim 11, comprising one or a plurality of the liquid supply tubes.

15. A liquid ejecting apparatus according to claim 11, wherein the cover structure includes a projection, the gap forming member includes a fitting recess in which the projection is fitted and the gap forming member is attached to the projection by the protrusion which is fitted in the fitting recess.

16. A liquid apparatus according to claim 11, wherein the gap forming member, when pressing the detector, has an engaging portion for engaging a edge of the recess.

* * * * *